US012428955B2

(12) United States Patent
Katanguri et al.

(10) Patent No.: US 12,428,955 B2
(45) Date of Patent: Sep. 30, 2025

(54) WELL EQUIPMENT SYSTEM FRAMEWORK

(71) Applicant: Schlumberger Technology Corporation, Sugar Land, TX (US)

(72) Inventors: Suman Katanguri, Sugar Land, TX (US); Dinesh Kumar Dhamodaran, Coimbatore (IN); Jesse Hardt, Sugar Land, TX (US); Prasadh Rajagopal, Coimbatore (IN); Manuel Francis T, Coimbatore (IN); Matthew Olson, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/505,328

(22) Filed: Nov. 9, 2023

(65) Prior Publication Data

US 2025/0154866 A1 May 15, 2025

(51) Int. Cl.

| | |
|---|---|
| ***G01N 35/00*** | (2006.01) |
| ***E21B 33/035*** | (2006.01) |
| ***E21B 47/18*** | (2012.01) |
| ***G06F 3/04815*** | (2022.01) |
| ***H04L 41/22*** | (2022.01) |

(52) U.S. Cl.
CPC ..... *E21B 47/18* (2013.01)

(58) Field of Classification Search
CPC ..... E21B 47/18
See application file for complete search history.

(56) References Cited

U.S. PATENT DOCUMENTS

| | | | | |
|---|---|---|---|---|
| 2012/0197527 | A1* | 8/2012 | McKay | E21B 33/064 702/6 |
| 2019/0203549 | A1* | 7/2019 | Parthasarathy | E21B 21/08 |
| 2019/0227087 | A1* | 7/2019 | Belani | G01N 33/24 |
| 2020/0274773 | A1* | 8/2020 | Mortsolf | G06F 3/04815 |
| 2021/0301618 | A1* | 9/2021 | Gabaldon | E21B 21/082 |
| 2022/0195848 | A1* | 6/2022 | Olson | E21B 33/062 |

FOREIGN PATENT DOCUMENTS

| | | | | |
|---|---|---|---|---|
| AU | 2015204064 B2 * | 3/2018 | | E21B 33/0355 |
| WO | 2023107596 A1 | 6/2023 | | |

OTHER PUBLICATIONS

Wygle, Peter R., Blowout Prevention In California, Equipment Selection and Testing, California Department of Conservation, Division of Oil, Gas, and Geothermal Resources, Publication No. M07, 10th edition, 2006, 25 pages.

* cited by examiner

*Primary Examiner* — Curtis A Kuntz
*Assistant Examiner* — Jerold B Murphy
(74) *Attorney, Agent, or Firm* — Jeffrey D. Frantz

(57) ABSTRACT

A method can include generating a graphical user interface that includes vector graphics representations of equipment of a system for well operations, a data graphic for rendering sensor data of the system, and a graphical control actuatable to issue a control instruction for control of the system, where the system includes an uninterruptible power supply (UPS) and a blowout preventer (BOP), and where the UPS is selectively, operatively coupled to one or more electric actuators for changing a state of the BOP; responsive to operation of the system, receiving sensor data; and updating the data graphic based at least in part on the sensor data.

18 Claims, 21 Drawing Sheets

1701

WELL EQUIPMENT SYSTEM FRAMEWORK

COPYRIGHT NOTICE

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

BACKGROUND

A reservoir can be a subsurface formation (e.g., a formation reservoir) that can be characterized at least in part by its porosity and fluid permeability. As an example, a reservoir may be part of a basin such as a sedimentary basin. A basin can be a depression (e.g., caused by plate tectonic activity, subsidence, etc.) in which sediments accumulate. As an example, where hydrocarbon source rocks occur in combination with appropriate depth and duration of burial, a petroleum system may develop within a basin, which may form a reservoir that includes hydrocarbon fluids (e.g., oil, gas, etc.). Various operations may be performed in the field to access such hydrocarbon fluids and/or produce such hydrocarbon fluids. For example, consider equipment operations where equipment may be controlled to perform one or more operations.

SUMMARY

A method can include generating a graphical user interface that includes vector graphics representations of equipment of a system for well operations, a data graphic for rendering sensor data of the system, and a graphical control actuatable to issue a control instruction for control of the system, where the system includes an uninterruptible power supply (UPS) and a blowout preventer (BOP), and where the UPS is selectively, operatively coupled to one or more electric actuators for changing a state of the BOP; responsive to operation of the system, receiving sensor data; and updating the data graphic based at least in part on the sensor data. A system can include a processor; memory accessible to the processor; processor-executable instructions stored in the memory and executable by the processor to instruct the system to: generate a graphical user interface that includes vector graphics representations of equipment of a system for well operations, a data graphic for rendering sensor data of the system, and a graphical control actuatable to issue a control instruction for control of the system, where the system includes an uninterruptible power supply (UPS) and a blowout preventer (BOP), and where the UPS is selectively, operatively coupled to one or more electric actuators for changing a state of the BOP; responsive to operation of the system, receive sensor data; and update the data graphic based at least in part on the sensor data. One or more computer-readable storage media can include processor-executable instructions to instruct a computing system to: generate a graphical user interface that includes vector graphics representations of equipment of a system for well operations, a data graphic for rendering sensor data of the system, and a graphical control actuatable to issue a control instruction for control of the system, where the system includes an uninterruptible power supply (UPS) and a blowout preventer (BOP), and where the UPS is selectively, operatively coupled to one or more electric actuators for changing a state of the BOP; responsive to operation of the system, receive sensor data; and update the data graphic based at least in part on the sensor data. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

This description is not to be taken in a limiting sense, but rather is made merely for the purpose of describing the general principles of the implementations. The scope of the described implementations should be ascertained with reference to the issued claims.

Below, various environments, systems, types of equipment, frameworks, etc., are described with respect to field operations. As explained, various equipment can be provided for blowout protection.

Figure 1:
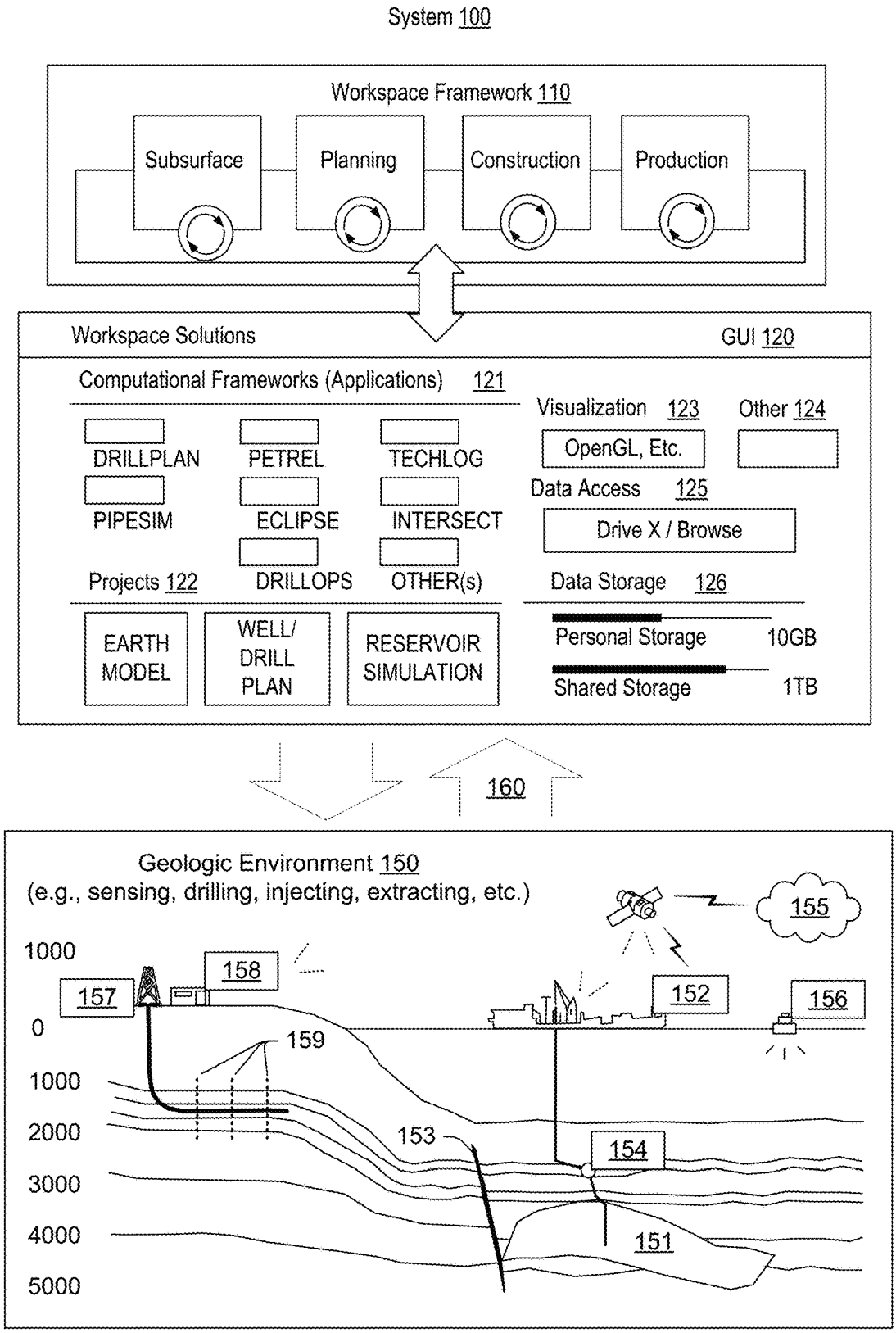
FIG. 1 illustrates an example system that includes various framework components associated with one or more geologic environments.

FIG. 1 shows an example of a system 100 that includes a workspace framework 110 that can provide for instantiation of, rendering of, interactions with, etc., a graphical user interface (GUI) 120. In the example of FIG. 1, the GUI 120 can include graphical controls for computational frameworks (e.g., applications) 121, projects 122, visualization 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, predictors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, predicting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, PETREL, TECHLOG, PETROMOD, ECLIPSE, INTERSECT and DRILLOPS frameworks (SLB, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The DRILLOPS framework may execute a digital drilling plan and ensures plan adherence, while delivering goal-based automation. The DRILLOPS framework may generate activity plans automatically for individual operations, whether they are monitored and/or controlled on the rig or in town. Automation may utilize data analysis and learning systems to assist and optimize tasks, such as, for example, setting ROP to drilling a stand. A preset menu of automatable drilling tasks may be rendered, and, using data analysis and models, a plan may be executed in a manner to achieve a specified goal, where, for example, measurements may be utilized for calibration. The DRILLOPS framework provides flexibility to modify and replan activities dynamically, for example, based on a live appraisal of various factors (e.g., equipment, personnel, and supplies). Well construction activities (e.g., tripping, drilling, cementing, etc.) may be continually monitored and dynamically updated using feedback from operational activities. The DRILLOPS framework may provide for various levels of automation based on planning and/or re-planning (e.g., via the DRILLPLAN framework), feedback, etc.

The PETREL framework can be part of the DELFI cognitive exploration and production (E&P) environment (SLB, Houston, Texas, referred to as the DELFI environment) for utilization in geosciences and geoengineering, for example, to analyze subsurface data from exploration to production of fluid from a reservoir.

One or more types of frameworks may be implemented within or in a manner operatively coupled to the DELFI environment, which is a secure, cognitive, cloud-based collaborative environment that integrates data and workflows with digital technologies, such as artificial intelligence (AI) and machine learning (ML). As an example, such an environment can provide for operations that involve one or more frameworks. The DELFI environment may be referred to as the DELFI framework, which may be a framework of frameworks. As an example, the DELFI environment can include various other frameworks, which can include, for example, one or more types of models (e.g., simulation models, etc.).

The TECHLOG framework can handle and process field and laboratory data for a variety of geologic environments (e.g., deepwater exploration, shale, etc.). The TECHLOG framework can structure wellbore data for analyses, planning, etc.

The PIPESIM simulator includes solvers that may provide simulation results such as, for example, multiphase flow results (e.g., from a reservoir to a wellhead and beyond, etc.), flowline and surface facility performance, etc. The PIPESIM simulator may be integrated, for example, with the AVOCET production operations framework (SLB, Houston Texas). As an example, a reservoir or reservoirs may be simulated with respect to one or more enhanced recovery techniques (e.g., consider a thermal process such as steam-assisted gravity drainage (SAGD), etc.). As an example, the PIPESIM simulator may be an optimizer that can optimize one or more operational scenarios at least in part via simulation of physical phenomena.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework can produce reliable results, which may be continuously updated by real-time data exchanges (e.g., from one or more types of data acquisition equipment in the field that can acquire data during one or more types of field operations, etc.). The INTERSECT framework can provide completion configurations for complex wells where such configurations can be built in the field, can provide detailed chemical enhanced-oil-recovery (EOR) formulations where such formulations can be implemented in the field, can analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI cognitive E&P environment, for example, for rapid simulation of multiple concurrent cases. For example, a workflow may utilize one or more of the DELFI on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 can be utilized for directing, controlling, etc., one or more processes in the geologic environment 150 and, feedback 160, can be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G software packages.

In the example of FIG. 1, the visualization 123 features may be implemented via the workspace framework 110, for example, to perform tasks as associated with one or more of subsurface regions, planning operations, constructing wells and/or surface fluid networks, and producing from a reservoir.

As an example, a visualization process can implement one or more of various features that can be suitable for one or more web applications. For example, a template may involve use of the JAVASCRIPT object notation format (JSON) and/or one or more other languages/formats. As an example, a framework may include one or more converters. For example, consider a JSON to PYTHON converter and/or a PYTHON to JSON converter. In such an approach, one or more features of a framework that may be available in one language may be accessed via a converter. For example, consider the APACHE SPARK framework that can include features available in a particular language where a converter may convert code in another language to that particular language such that one or more of the features can be utilized. As an example, a production field may include various types of equipment, be operable with various frameworks, etc., where one or more languages may be utilized. In such an example, a converter may provide for feature flexibility and/or compatibility.

As an example, visualization features can provide for visualization of various earth models, properties, etc., in one or more dimensions. As an example, visualization features can provide for rendering of information in multiple dimensions, which may optionally include multiple resolution rendering. In such an example, information being rendered may be associated with one or more frameworks and/or one or more data stores. As an example, visualization features may include one or more control features for control of equipment, which can include, for example, field equipment that can perform one or more field operations. As an example, a workflow may utilize one or more frameworks to generate information that can be utilized to control one or more types of field equipment (e.g., drilling equipment, wireline equipment, fracturing equipment, etc.).

As an example, a visualization framework such as the Open Graphics Library (OpenGL) framework (Khronos Group, Beaverton, Oregon) may be utilized for visualizations. The OpenGL framework provides a cross-language, cross-platform application programming interface for rendering 2D and 3D vector graphics where the application programming interface may be used to interact with a graphics processing unit (or units), to achieve hardware-accelerated rendering.

As an example, one or more types of visualization frameworks may be utilized. As an example, vector graphics may be utilized. As an example, one or more features of the Graphics Language (GL) Transmission Format (gITF) family may be utilized (Khronos Group, Beaverton, Oregon). As an example, the GLB binary file format may be utilized, for example, for representation of 3D models saved in the gITF. Information about 3D models such as node hierarchy, cameras, materials, animations and meshes may be stored in a binary format. As an example, a binary format may store a gITF asset (e.g., JSON, .bin and images) in a binary large object (blob). As an example, GLB may be utilized to help reduce issues of an increase in file size which may occur in various instances with gITF. For example, the GLB file format may result in compact file sizes, fast loading, complete 3D scene representation, and extensibility for further development.

As to the gITF, it is a standard file format for three-dimensional scenes and models. A gITF file may use file extensions such as, for example, .gltf (e.g., JSON/ASCII) or .glb (e.g., binary). Both .gltf and .glb files may reference external binary and texture resources. As an example, such formats may be self-contained by directly embedding binary data buffers (e.g., as base64-encoded strings in .gltf files or as raw byte arrays in .glb files). As an example, a framework may support 3D model geometry, appearance, scene graph hierarchy, and animation. As an example, a framework may help to streamline operations and be an interoperable format for delivery of graphics assets, for example, while minimizing file size and runtime processing by one or more applications. As an example, an application may be built using the WebGL application programming interface (API) (Khronos Group, Beaverton, Oregon). As an example, the WebGL API may utilize HTML5 canvas elements. As an example, WebGL may be browser implemented.

As an example, Scalable Vector Graphics (SVG) may be utilized, which may be in the form of an XML-based vector image format that may define graphics, which may have support for interactivity and animation. As an example, SVG images may be defined in a vector graphics format and stored in XML text files. SVG images may be scaled in size without loss of quality, and SVG files may be searched, indexed, scripted, and/or compressed. As an example, an XML text file may be created and/or edited (e.g., using text editors and/or vector graphics editors). As an example, an XML file may include information that can drive rendering of graphics to a display (e.g., consider web browser type of rendering, etc.).

While several simulators are illustrated in the example of FIG. 1, one or more other simulators may be utilized, additionally or alternatively. For example, consider the VISAGE geomechanics simulator (SLB, Houston Texas) or the PETROMOD simulator (SLB, Houston Texas), etc. The VISAGE simulator includes finite element numerical solvers that may provide simulation results such as, for example, results as to compaction and subsidence of a geologic environment, well and completion integrity in a geologic environment, cap-rock and fault-seal integrity in a geologic environment, fracture behavior in a geologic environment, thermal recovery in a geologic environment, $CO_2$ disposal, etc. The PETROMOD framework provides petroleum systems modeling capabilities that can combine one or more of seismic, well, and geological information to model the evolution of a sedimentary basin. The PETROMOD framework can predict if, and how, a reservoir has been charged with hydrocarbons, including the source and timing of hydrocarbon generation, migration routes, quantities, and hydrocarbon type in the subsurface or at surface conditions. The MANGROVE simulator (SLB, Houston, Texas) provides for optimization of stimulation design (e.g., stimulation treatment operations such as hydraulic fracturing) in a reservoir-centric environment. The MANGROVE framework can combine scientific and experimental work to predict geomechanical propagation of hydraulic fractures, reactivation of natural fractures, etc., along with production forecasts within 3D reservoir models (e.g., production from a drainage area of a reservoir where fluid moves via one or more types of fractures to a well and/or from a well).

Figure 2:
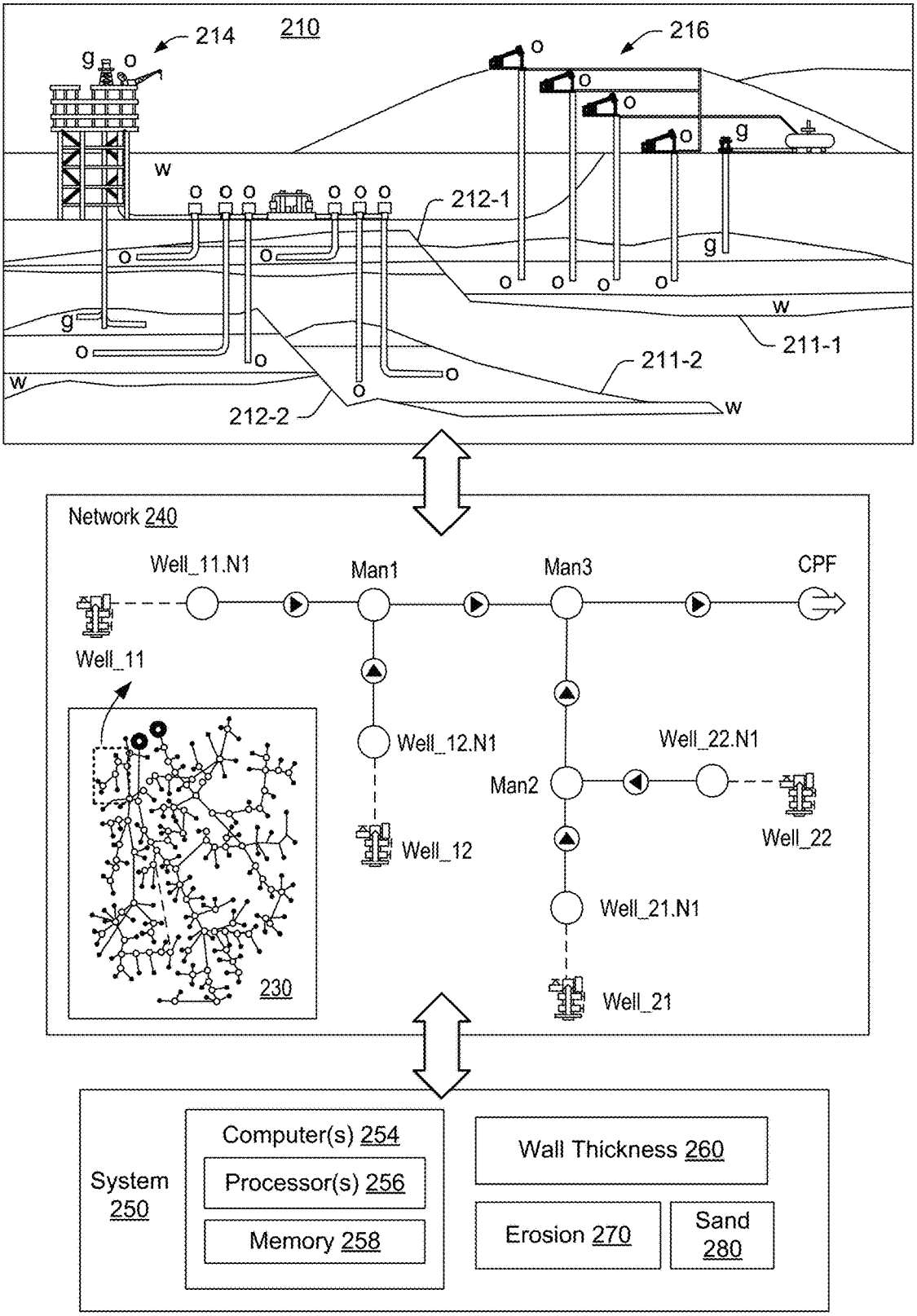
FIG. 2 illustrates examples of equipment, an example of a network and an example of a system.

FIG. 2 shows an example of a geologic environment 210 that includes reservoirs 211-1 and 211-2, which may be faulted by faults 212-1 and 212-2, an example of a network of equipment 230, an enlarged view of a portion of the network of equipment 230, referred to as network 240, and an example of a system 250. FIG. 2 shows some examples of offshore equipment 214 for oil and gas operations related to the reservoir 211-2 and onshore equipment 216 for oil and gas operations related to the reservoir 211-1. In the example of FIG. 2, the geologic environment 210 can include fluids such as oil (o), water (w) and gas (g), which may be stratified in the reservoirs 211-1 and 211-2.

In the example of FIG. 2, the equipment 214 and 216 can include one or more of drilling equipment, wireline equipment, production equipment, etc. For example, consider the equipment 214 as including a drilling rig that can drill into a formation to reach a reservoir target where a well can be completed for production of hydrocarbons. As an example, the equipment 216 can include production equipment such as wellheads, valves, pump equipment, gas handling equipment, etc. As an example, one or more features of the system 100 of FIG. 1 may be utilized for operations in the geologic environment 210. For example, consider utilizing a drilling or well plan framework, a drilling execution framework, a production framework, etc., to plan, execute, etc., one or more drilling operations, production operations, etc.

In FIG. 2, the network 240 can be an example of a relatively small production system network. As shown, the network 240 forms somewhat of a tree like structure where flowlines represent branches (e.g., segments) and junctions represent nodes. As shown in FIG. 2, the network 240 provides for transportation of fluid (e.g., oil, water and/or gas) from well locations (e.g., Well_11, Well_12, Well_21, and Well_22) along flowlines interconnected at junctions with final delivery at a central processing facility (CPF). Where fluid includes solids (e.g., sand, etc.), one or more pieces of equipment may provide for solids removal, collection, etc.

In the example of FIG. 2, various portions of the network 240 may include conduit. For example, consider a perspective view of a geologic environment that includes two conduits which may be a conduit to Man1 and a conduit to Man3 in the network 240, where Man1, Man2 and Man3 are manifolds. In the example of FIG. 2, various portions of the network of equipment 230 can include one or more pumps, which can include one or more surface and/or subsurface pumps.

As shown in FIG. 2, the example system 250 includes one or more computers 254 and one or more sets of instructions 260, 270 and 280. As to the one or more computers 254, each computer may include one or more processors (e.g., or processing cores) 256 and memory 258 for storing instructions (e.g., one or more of the sets of instructions 260, 270 and 280), for example, executable by at least one of the one or more processors 256. As an example, a computer may include one or more network interfaces (e.g., wired or wireless), one or more graphics cards, a display interface (e.g., wired or wireless), etc. As an example, imagery such as surface imagery (e.g., satellite, geological, geophysical, etc.) may be stored, processed, communicated, etc. As an example, data may include SAR data, GPS data, etc. and may be stored, for example, in one or more storage devices. As an example, information that may be stored in the one or more storage devices may include information about equipment, location of equipment, orientation of equipment, fluid characteristics, etc.

As an example, the instructions 260 can include instructions (e.g., stored in the memory 258) executable by at least one of the one or more processors 256 to instruct the system 250 to perform various actions related to wall thickness of one or more pieces of equipment (e.g., conduits, etc.), where wall thickness may change as a result of sand being present in hydrocarbon fluid.

As an example, the instructions 270 can include instructions (e.g., stored in the memory 258) executable by at least one of the one or more processors 256 to instruct the system 250 to perform various actions related to erosion of one or more pieces of equipment (e.g., conduits, etc.), where erosion may occur as a result of sand being present in hydrocarbon fluid.

As an example, the instructions 280 can include instructions (e.g., stored in the memory 258) executable by at least one of the one or more processors 256 to instruct the system 250 to perform various actions related to sand, which, as explained, can be liberated by a formation via one or more mechanisms (e.g., entrainment of existing sand, dissolution of formation rock, fracturing of formation rock, etc.).

As an example, the system 250 may be configured to provide for establishing one or more frameworks, for example, consider a framework that can provide for sand monitoring and/or control, a framework that can perform network modeling (see, e.g., the PIPESIM framework of the example of FIG. 1, etc.) and/or other modeling. As an example, one or more methods, techniques, etc. may be performed using one or more sets of instructions.

As an example, various graphics in FIG. 2 may be part of a graphical user interface (GUI) that can be generated using executable instructions that may be executable locally and/or remotely using local and/or remote display devices (e.g., a mobile device, a workstation, etc.).

Figure 3:
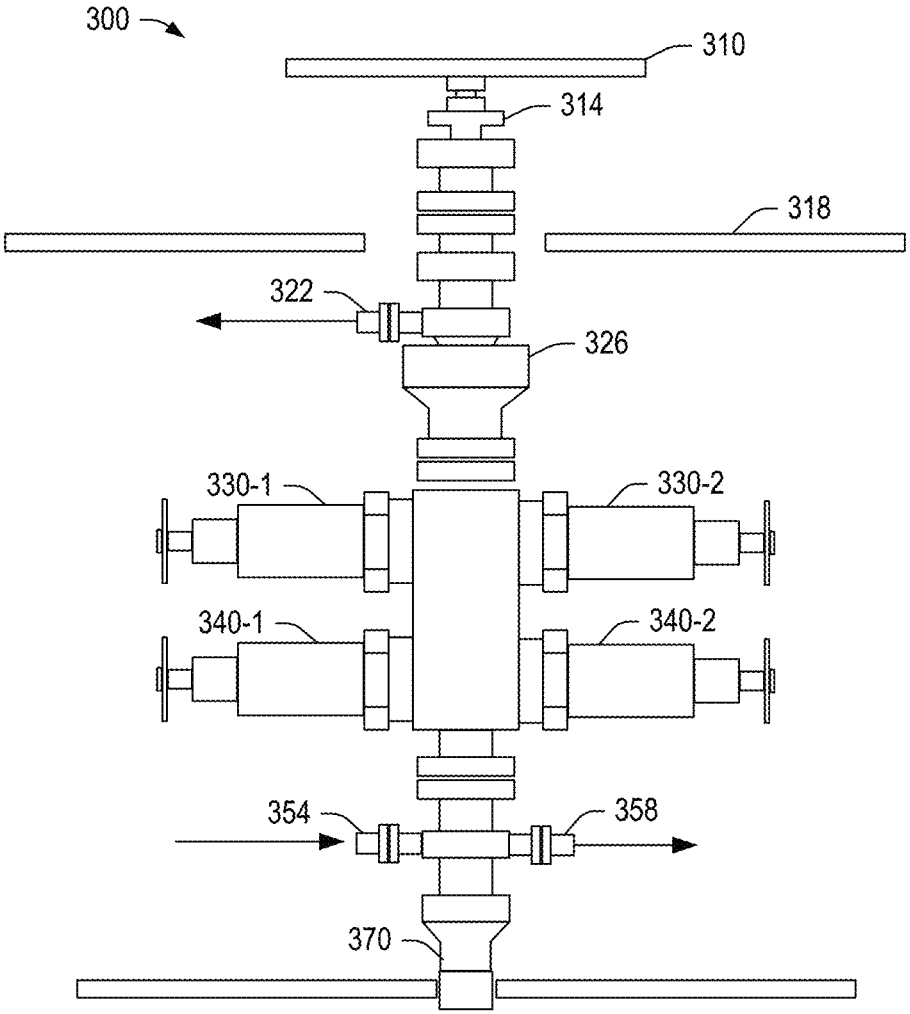
FIG. 3 illustrates examples of equipment.
Figure 3:
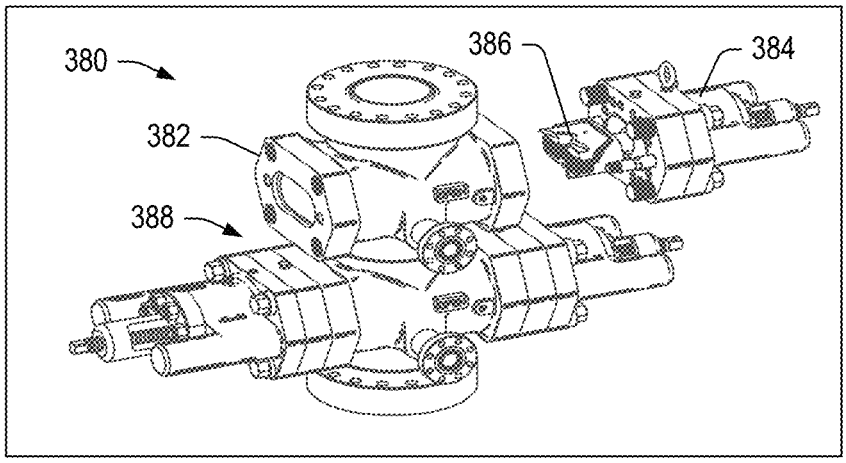

FIG. 3 shows an example of a blowout preventer (BOP) 300 and a perspective view of an example of an assembly of components 380. As shown, the BOP 300 can include an injector head 310, a stripper 314 that may be disposed at an axial position above a rig floor 318 where, for example, below the rig floor 318, the BOP 300 can include one or more mud returns 322, an annular preventer 326, blind rams 330-1 and 330-2, shear rams 340-1 and 340-2, a kill line fitting 354, a choke line fitting 358 and a wellhead, casing or Christmas tree 370 that may be at a ground level. The BOP 300 can be defined as a BOP stack, which is generally a stack of components that form an assembly for blowout prevention.

As shown in FIG. 3, the assembly of components 380 can include a body 382, a bonnet 384 and a ram assembly 386. As shown, the body 382 can include various flanges, for example, flanges for mounting the body 382 to another body and flanges for bonnet mounting. In the example of FIG. 3, the assembly of components 380 shows the body 382 as being mounted to another body with bonnets and ram assemblies 388. In the example of FIG. 3, the assembly of components 380 may include features of a U BOP (SLB, Houston, Texas), an UM BOP (SLB, Houston, Texas), and/or one or more other BOPs.

As an example, a BOP stack may be a set of two or more BOPs used to ensure pressure control of a well. For example, a stack might include one to six ram-type preventers and, optionally, one or two annular-type preventers. As an example, a stack configuration may include ram preventers on the bottom and annular preventers at the top.

A configuration of a stack of preventers may be optimized to provide desired pressure integrity, safety and flexibility in the event of a well control incident. For example, in a multiple ram configuration, one set of rams might be fitted to close on 5-in diameter drillpipe, another set configured for 4½-in drillpipe, a third fitted with blind rams to close on the openhole, and a fourth fitted with a shear ram that can cut and hang-off the drillpipe as a last resort.

In various examples, an annular preventer or two may be provided on the top of a stack as annular preventers can be closed over a wide range of tubular sizes and an openhole, but they may not be rated for pressures as high as ram preventers. As an example, a BOP stack can include various spools, adapters and piping outlets to permit circulation of wellbore fluid under pressure in the event of a well control incident.

As an example, a BOP can include a relatively large valve at a top of a well that may be closed if a drilling crew loses control of formation fluids. By closing this valve, which may be operated remotely via one or more hydraulic actuators, the drilling crew may regain control of a reservoir where, for example, one or more procedures may be initiated to increase mud density until it is possible to open the BOP and retain pressure control of the formation.

BOPs can be configured in a variety of styles, sizes, and pressure ratings. As an example, a BOP may effectively close over an open wellbore. As an example, a BOP may be designed to seal around one or more tubular components in a well (e.g., drillpipe, casing, or tubing). As an example, a BOP may be fitted with hardened steel shearing surfaces that can actually cut through drillpipe.

As a BOP is important to safety of a crew, a rig, and a wellbore itself, BOPs are inspected, tested, and refurbished at regular intervals determined by a combination of risk assessment, local practice, well type, and legal requirements. BOP tests may vary, for example, from daily function testing on critical wells to monthly or less frequent testing on wells thought to have low probability of well control problems.

As an example, a blind ram can be a thick, heavy steel component of a ram BOP. In a normal pipe ram, two blocks of steel that meet in the center of a wellbore to seal the well can have a hole (e.g., one-half of the hole on each piece) through which the pipe fits. A blind ram has no space for pipe and is instead blanked off to be able to close over a well that does not contain a drillstring. It may be loosely thought of as the sliding gate on a gate valve.

As an example, a shear ram can be a BOP closing element fitted with hardened tool steel blades designed to cut drillpipe or tubing when the BOP is closed, and then fully close to provide isolation or sealing of a wellbore. A shear ram may be used as a last resort to regain pressure control of a well that is flowing. Once drillpipe is cut (or sheared) by the shear rams, it is usually left hanging in the BOP stack, and kill operations become more difficult. A joint of drillpipe or tubing is destroyed in the process, but the rest of the string is unharmed by the operation of shear rams.

As an example, an annular preventer can be or include a relatively large valve that can be used to control wellbore fluids. In this type of valve, the sealing element resembles an elastic doughnut that can be mechanically squeezed inward to seal on either pipe (e.g., drill collar, drillpipe, casing, or tubing) or an openhole.

As explained, a BOP or BOP stack can be a conditional surface pressure barrier that can be configured in a desired manner, for example, to include one or more sets of hydraulically operated rams that include components designed to grip pipe, seal around pipe, shear off pipe or seal an openhole during drilling or a workover. As explained, a BOP or BOP stack may include an annular preventer.

The American Petroleum Institute (API) provides various definitions and guidance for BOPs. For example, consider the API Recommended Practices (RP) 53 Blowout Prevention Equipment Systems For Drilling Wells specification (e.g., 3$^{rd}$ Edition, March 1997). According to the API, the purpose of these recommended practices is to provide information that can serve as a guide for installation and testing of blowout prevention equipment systems on land and marine drilling rigs (barge, platform, bottom-supported, and floating). Blowout prevention equipment systems are composed of systems required to operate the blowout preventers (BOPS) under varying rig and well conditions. According to API, these systems are: blowout preventers (BOPs), choke and kill lines, choke manifold, hydraulic control system, marine riser, and auxiliary equipment. The primary functions of these systems are to confine well fluids to the wellbore, provide means to add fluid to the wellbore, and allow controlled volumes to be withdrawn from the wellbore. In API RP 53, diverter systems are also addressed, though their primary purpose is to safely divert flow rather than to confine fluids to the wellbore.

Figure 4:
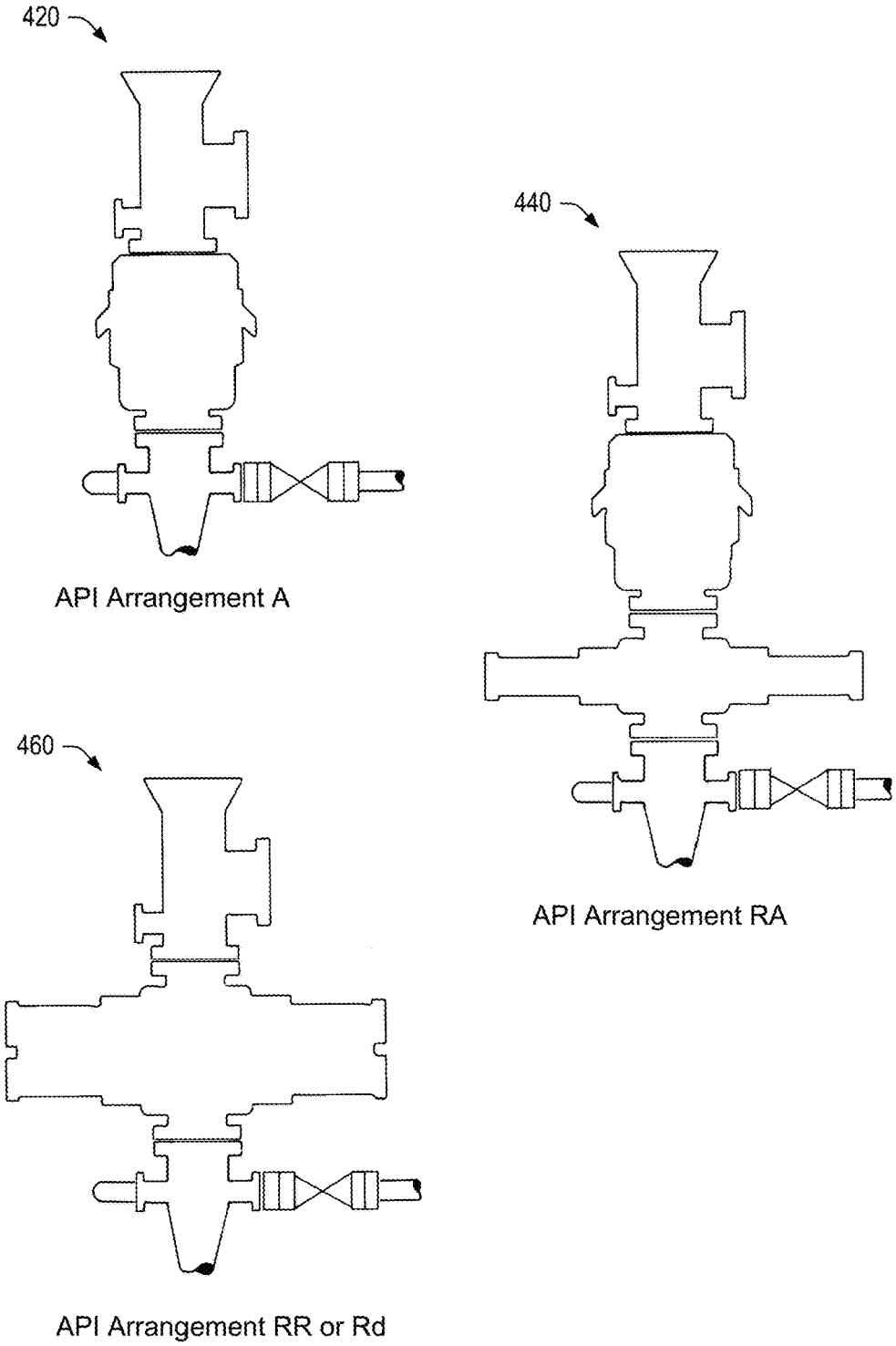
FIG. 4 illustrates examples of equipment.

FIG. 4 shows some examples of BOPs 420, 440 and 460, which correspond to API Class II types of blowout prevention equipment (BOPE). In particular, the BOP 420 is a Class II annular-type preventer ("A"), the BOP 440 is a Class II with single ram-type preventer with one set of rams (e.g., either blank or for pipe) and with an annular-type preventer, and the BOP 460 is a Class II with two ram-type preventers or a double ram-type preventer with two sets of rams, positioned in accord with an operator's choice. According to the API, the letter "S" can be utilized to indicate a drilling spool with side outlet connections, for example, for one or more of choke and kill lines.

As an example, a kill line can be a relatively high-pressure pipe leading from an outlet on a BOP stack to high-pressure rig pumps (e.g., drilling fluid pumps). During normal well control operations, kill fluid can be pumped through a drillstring and annular fluid taken out of the well through a choke line to a choke, which can be utilized to reduce fluid pressure (e.g., drop fluid pressure to atmospheric pressure). If a drillpipe is inaccessible, it may be necessary to pump heavy drilling fluid in the top of the well, wait for the fluid to fall under the force of gravity, and then remove fluid from the annulus. In such an operation, while one high pressure line may suffice, it can be more convenient to have two lines. In addition, such an approach provides a measure of redundancy for operation. In floating offshore operations, choke and kill lines may exit a subsea BOP stack and run along outside of a riser to the surface. The volumetric and frictional effects of these long choke and kill lines can be taken into account for well control.

As an example, a BOP can utilize one or more types of mechanisms to drive a ram, a valve, etc. For example, consider one or more of manual, hydraulic and electrical. As an example, an electric BOP control system can utilize a servo that includes a servo motor and drive, which may be interfaced for remote monitoring and/or operation. As an example, one or more torque control algorithms may be tuned for optimal operation based on system demand, which may increase availability and utilization, which may further result in efficient operation. As an example, a hybrid BOP system can include a battery interface where, for example, an advanced battery management system may be connected to a controller. In such an example, one or more types of secured protocols may be implemented. As an example, connectivity may be elevated to one or more remote interface systems that can provide a platform for advanced battery module management, for example, to maximize availability.

Industry standards (e.g., API) for various BOPs can specify that ram BOPs and annular BOPs are to close within a certain number of seconds (e.g., 45 seconds for ram and 60 seconds for annular); noting that operators may aim to close as fast as is practical. Various BOP control systems are hydraulic where directional control valves in control pods on a BOP stack may be controlled via hydraulic pulses (e.g., pressure up and/or bleed off) through pilot hoses. So-called hybrid electro-hydraulic (EH) control systems may utilize, for example, a pump/accumulator unit, a universal or uninterruptible power supply (UPS), electrical wiring, etc. As an example, a system may utilize electrical lines coupled to solenoid pod functions (e.g., rams, annulars and possibly connector release), which can provide for timely operation, noting that hydraulic pilot lines may also be utilized (e.g., for non-critical time dependent functions). As an example, an assembly that may include one or more solenoids and hydraulic/electrical connectors may be packaged to fit with an existing all-hydraulic control pod.

As an example, a BOP system can include various electrical devices that can operate using electrical power, which may be from a grid and/or one or more other power sources, which may include batteries. As an example, an electric ram may be rated by a maximum electrical power consumption for one or more functions, which may be an instantaneous maximum load. For example, consider a load of 5 KW to 100 KW or more that can be utilized to drive a ram in a desired amount of time (e.g., from 5 seconds to 100 seconds). As an example, one or more actuators may be idle and ready to receive electrical power to deliver a desired amount of torque. As an example, one or more types of preventers may be utilized as backups and/or for accidents.

As explained, an electric system can utilize live electrical power and/or battery electrical power. As an example, a site may include one or more types of power management system, which can provide for selecting one or more sources of energy for one or more purposes. As an example, a site may include a battery system, which includes banks of batteries, which may include, for example, lithium-based batteries (e.g., lithium-ion, lithium metal, etc.).

As an example, a BOP or BOP stack may be configured in an integrative manner with respect to power. For example, consider use of hydraulic, hydraulic-electric and/or electric preventers and/or diverters as part of a BOP system where appropriate power is to be available for implementation in the field. As more options become available for BOP systems, the complexity and logistics of BOP system design can increase, while still aiming to comply with one or more of various standards (e.g., API, etc.). For example, if a risk exists as to availability of electrical power, then battery backup may be required and/or use of hydraulics. In such an example, if battery backup is present, then one or more systems may be demanded for monitoring and appropriately managing the battery backup. For example, lithium-ion batteries may be cycled, temperature controlled, etc., such that a bank of batteries has increased longevity and persistent availability of charge sufficient for one or more BOP system operations.

Figure 5:
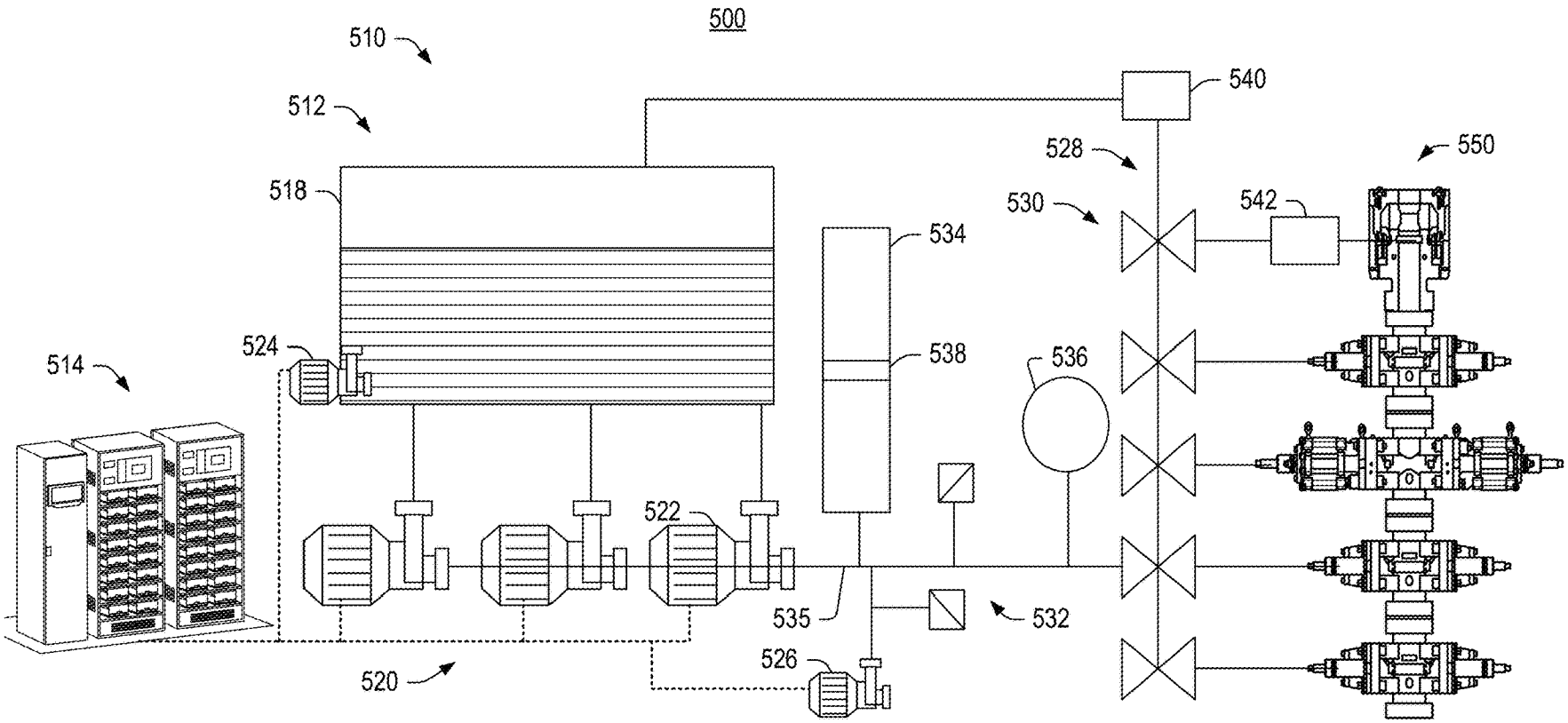
FIG. 5 illustrates an example of a system.

FIG. 5 shows an example of a system 500 that can include a control system 510 that may include a hybrid electric closing unit 512, a battery system 514 that can include a remote operator panel. As shown, the electric closing unit 512 can includes at least a tank 518, at least one primary pump 520, a pneumatic pump 526 (e.g., noting that an electric pump may be utilized), a valve manifold 528, a pressure sensing system 532, and a pressure storage reservoir 534. As shown, the at least one primary pump 520, the pressure storage reservoir 534, the pressure sensing system 532, and the valve manifold 528 are hydraulically connected with the tank 518 via a hydraulic circuit 535. The at least one primary pump 520 and the pneumatic pump 526 may be powered by an electric energy source (see, e.g., dashed lines, which may be wired or wireless). As an example, the pneumatic pump 526 may be powered by compressed air.

In FIG. 5, the tank 518 of the hybrid electric closing unit 512 can include a usable volume of the control system 510. That is, the tank 518 can include a usable volume of hydraulic fluid in accordance with applicable regulations, for example. The hybrid electric closing unit 512 may include the at least one primary pump 520 that is configured to pump hydraulic fluid from the usable volume of the tank 518. The hybrid electric closing unit 512 may also include at least one spare pump 522 in addition to the at least one primary pump 520. The spare pump 522 may be hydraulically connected to the at least one primary pump 520, the pressure storage reservoir 534, the valve manifold 528, and the pressure sensing system 532 along the hydraulic circuit 535, and the spare pump 522 may be powered by an electric energy source. The spare pump 522 may also be configured to pump hydraulic fluid from the usable volume of the tank 518.

The hybrid electric closing unit 512 may also include a recirculating pump 524 attached to the tank 518 for returning unused usable volume of hydraulic fluid back to the tank 518. The recirculating pump 524 may be powered by an electric energy source. Various pumps may be automatically and/or manually controlled, as to the latter, consider a scenario where the control system 510 has lost local control either from a programmable logic controller (PLC) or embedded controller.

The hybrid electric closing unit 512 may also include the valve manifold 528 with a plurality of valves 530. The plurality of valves 530 of the valve manifold 528 may be configured to operatively connect to a hydraulic device 550, such as a BOP stack or other pressure control equipment. More specifically, each valve of the plurality of valves 530 of the valve manifold 528 may be configured to connect to a particular preventer or function on the hydraulic device 550 (e.g., the BOP stack). For example, consider connection to an annular preventer of the hydraulic device 550 (e.g., the BOP stack), connection to different ram preventers of the hydraulic device 550 (e.g., the BOP stack), which may include one or more shear rams, pipe rams, or blind rams, for example, for controlling a function of the hydraulic device 550 (e.g., the BOP stack).

As shown in FIG. 5, a pressure regulator 542 may be disposed between the valve manifold 528 and the hydraulic device 550 or BOP stack. In this way, the plurality of valves 530 may be functional valves having regulated outputs to predefined functions of the hydraulic device 550 or BOP stack.

As shown in FIG. 5, the pneumatic pump 526 is hydraulically connected to the at least one primary pump 520, the pressure storage reservoir 534, the valve manifold 528, and the pressure sensing system 532 along the hydraulic circuit 535, and the pneumatic pump 526 is powered by an electric energy source. The hydraulic fluid within the control system 510 may have a predetermined static pressure. The pneumatic pump 526 of the hybrid electric closing unit 512 may function to maintain the control system 510 at a predetermined static pressure.

According to one or more embodiments of the present disclosure, a predetermined static pressure of the control system 510 may be approximately 3,000 psi, for example. However, the static pressure of the control system 510 may be at a different pressure level. The control system 510 may also include a pressure gauge 536 connected to the hydraulic circuit 535 for monitoring pressure in the control system 510. The pneumatic pump 526 may have an automatic and manual setting whereby a user can turn on the pneumatic pump 526 manually in case the control system 510 has lost local control either from the PLC or embedded controller.

The hybrid electric closing unit 512 may also include a pressure sensing system 532 disposed between the at least one primary pump 520 and the valve manifold 528. The pressure sensing system 532 may manage a start-stop operation of the at least one primary pump 520. The pressure sensing system 532 may include a first pressure sensor and a second pressure sensor (see, e.g., blocks with crosslines), each hydraulically connected via the hydraulic circuit 535. The pressure sensing system 532 may include a pressure switch or a pressure transducer that, for example, provides a first electric signal to start the at least one primary pump 520 when the hydraulic fluid within the control system 510 drops to at least a first pressure below the predetermined static pressure. Such a pressure drop in the control system 510 may be monitored by the pressure gauge 536 connected to the hydraulic circuit 535. A first pressure sensor may be configured to stop or turn off when hydraulic fluid within the control system 510 returns to the predetermined static pressure. As to a second pressure sensor, it may be configured to provide a second electric signal to start the pneumatic pump 526 when hydraulic fluid within the control system 510 drops to at least a second pressure below the predetermined static pressure. Such a pressure drop in the control system 510 may be monitored by the pressure gauge 536 connected to the hydraulic circuit 535. Such a second pressure sensor may be configured to stop or turn off when the hydraulic fluid within the control system 510 returns to the predetermined static pressure.

The hybrid electric closing unit 512 may include a pressure storage reservoir 534, which may be a piston accumulator or a bladder accumulator, for example. The pressure storage reservoir 534 may include a movable member 538 that separates a charged-gas section filled with an inert gas (e.g., nitrogen) and a hydraulic-fluid section filled with hydraulic fluid, for example, connected to the hydraulic circuit 535 so that the hydraulic fluid may be used to operate the hydraulic device 550, such as a component of a BOP stack or other well equipment. As hydraulic fluid is discharged from the fluid section, the movable member 538 moves within the pressure storage reservoir 534 under pressure from the gas to maintain pressure on the remaining hydraulic fluid until full discharge. Thus, as hydraulic fluid is discharged from the fluid section, the movable member 538 moves, making the gas section larger and the fluid section smaller. Alternatively, the pressure storage reservoir 534 may include an elastomer bladder filled with an inert gas disposed in a pressure vessel containing hydraulic fluid. When the pressure drops in the control system 510, the compressed gas in the bladder of the pressure storage reservoir 534 expands and pushes the stored hydraulic fluid into the hydraulic circuit 535 so that the hydraulic fluid may be used to operate the hydraulic device 550.

The hybrid electric closing unit 512 may also include components for regulating hydraulic pressure 540 hydraulically connected to the valve manifold 528, for example, where such an approach can return hydraulic fluid to the tank 518 if a pressure of the control system 510 exceeds the predetermined static pressure of the control system 510. As to the components for regulating hydraulic pressure 540, consider one or more of a bypass regulator, a backpressure regulator, a relief valve, a variable displacement pump, a variable speed motor, or other equivalent structures that either actively or passively control the hydraulic fluid flowing through the valve manifold 528, for example.

In the example of FIG. 5, electric energy source of the control system 510 may include at least one of rig power, a rig generator, an uninterruptable power supply (UPS), and at least one battery system, alone or in any combination, without departing from the scope of the present disclosure. According to one or more embodiments of the present disclosure, the electric energy source of the control system 510 may include rig power as a primary energy source, at least one rig generator as a secondary energy source, and at least one battery system 514 as the tertiary energy source, for example. Alternatively, the at least one battery system 514 may be the primary energy source of the control system 510, and the rig power may be the secondary energy source of the control system 510, according to one or more embodiments of the present disclosure. Designations of primary, secondary, and tertiary energy sources are not limiting, however, and may change according to the needs of the control system 510 according to one or more embodiments of the present disclosure. According to one or more embodiments of the present disclosure, the at least one battery system 514 is trickle charged by a rig providing the rig power, for example.

As an example, the least one primary pump 520 of the control system 510 may operate at full force, as the pressure regulator 542 manages the system pressures that are ultimately applied to a component, for example. When the pressure of the control system 510 drops to at least the first pressure below the predetermined static pressure, such as to 2,500 psi, for example, the first pressure sensor of the pressure sensing system 532 may start or turn on, which starts or turns on the at least one primary pump 520. If the at least one primary pump 520 fails to turn on, the spare pump 522 may be turned on instead. The pumping action from the at least one primary pump 520 and/or the spare pump 522 pumps hydraulic fluid from the tank 518 into the hydraulic circuit 535, thereby increasing the pressure of the control system 510. As hydraulic fluid from the tank 518 is pumped into the hydraulic circuit 535, the pressure storage reservoir 534 is able to recharge with hydraulic fluid. When the pressure in the control system 510 is restored to the predetermined static pressure, which may be 3,000 psi, for example, the first pressure sensor stops or turns off. As an example, a method can include venting hydraulic fluid into the tank 518 via the components for regulating hydraulic pressure 540 (e.g., the bypass regulator) when the hydraulic fluid within the control system 510 exceeds the predetermined static pressure. Pumping action from the at least one primary pump 520 and/or the spare pump 522 may continue for a predetermined time after the control system 510 is restored to the predetermined static pressure. For example, pumping action from the at least one primary pump 520 and/or the spare pump 522 may continue for five seconds after the control system 510 is restored to the predetermined static pressure. However, this predetermined time of five seconds is non-limiting, and other times are contemplated and are within the scope of the present disclosure.

As an example, the control system 510 may include a remote operator panel. A remote operator panel may be located away from the hydraulic device 550 connected to the control system 510, which may be a BOP stack. For example, it may be located in a drilling cabin, in a tool pusher's cabin, or on the drilling floor, for example. A remote operator panel may facilitate remote operation of the control system 510, according to one or more embodiments of the present disclosure.

As an example, starting and stopping of one or more pumps of the control system 510 may be controlled by valve function either via a remote operator panel, an HMI, etc. A proximity sensor on a valve of the valve manifold 528 or an HMI function may trigger pumps to start and stop, according to one or more embodiments of the present disclosure. Moreover, pressure and flow through the control system 510 may be controlled by a predefined function. For example, if an annular function is fired, the control system 510 can auto-regulate the pump output to 1,500 psi, for example, and stop the flow when the pressure reaches the predetermined static level. There may be a gallon count for each function, according to one or more embodiments of the present disclosure, for example.

As an example, certain automatic safety operations may be integrated into the control system 510. For example, if the control system 510 loses power, a Deadman auto shear safety operation may automatically function, causing communications and hydraulic supply of the control system 510 to fire a predetermined set of functions to close in the well. As another example, in the case of a well control event, an operator can signal a function from either a push button or the HMI that will trigger a predetermined sequence of events for an emergency sequencing automatic function. As another example, in the case of a detected kick, the control system 510 according to one or more embodiments of the present disclosure may turn on the pumping system and sequence the automated system to function the BOP stack.

As explained, the control system 510 may include a battery system 514 for supplying electric energy to at least the pumps 520, 522 and 524 of the control system 510. A battery system may be connected to various components. For example, a battery system may be connected to a pump, as previously described, an electric actuator, or even an electric BOP, for example, for supplying electric energy to these components. As an example, a battery system may include an enclosure or a plurality of battery enclosures, for example. In one or more embodiments of the present disclosure, a single battery enclosure may operate as a stand-alone battery system, or a plurality of battery enclosures may be connected to each other, for example, in an interconnected battery system.

As an example, a battery system may include a battery management system and a plurality of battery packs, for example. A battery management system may include an HMI and an associated processor for receiving and displaying data regarding battery charge, battery health, whether a battery is online for communication, and potential alarm conditions, for example. According to one or more embodiments of the present disclosure, HMI displays or LED lights of a battery management system may trend and monitor overall charge of a battery system. According to one or more embodiments of the present disclosure, a battery management system may be capable of monitoring a battery system down to the battery cell level. As an example, a battery management system may be configured to manage equipment inclination, vibration, shock, static, intermittent temperatures, and long-term battery health in accordance with one or more embodiments of the present disclosure.

As explained, a computational framework can include a graphical user interface (GUI) generator; a logic generator; and a graphics generator; where, for example, the GUI generator generates a GUI for configuring a system of well equipment based on selections of graphical menu items, where the GUI dynamically responds to an interactive selection of one of the graphical menu items based on logic generated by the logic generator, and where the graphics generator generates a vector graphics representation of the system of well equipment as configured. In such an example, a GUI may render a representation of equipment, which may, for example, be presented in one or more GUIs, HMIs, etc. For example, the system 500 of FIG. 5 may be rendered as a GUI and/or an HMI where the hydraulic device 550 is generated by a computational framework, along with one or more indications for control (e.g., electrical control, hydraulic control, electrical and hydraulic control, etc.). While the hydraulic device 550 is referred to as being hydraulic, hydraulic may refer to well control (e.g., fluid control). As mentioned, the hydraulic device 550 may include one or more types of components, which may be electric components, hydraulic components and/or hydro-electric components.

As an example, the system 500 of FIG. 5 may include one or more features of one or more of the systems of FIG. 1, FIG. 2, FIG. 3 and/or FIG. 4. For example, the system 500 may be installed at a site where, for example, there may be one or more instances of the hydraulic device 550 (e.g., one for each wellhead, etc.).

Hybrid and electric BOP systems designed for advanced well control interface can utilize various types of drive systems and control mechanisms. As an example, a computational framework can generate one or more graphical user interfaces (GUIs) for facilitating operations, which can include various field operations associated with BOPs. For example, consider a computational framework that can generate one or more monitoring and/or control GUIs. In such an example, the framework may generate GUIs for well orchestration where, for example, each component design used in the GUI can have one or more features associated to equipment monitoring, operating, control, troubleshooting, etc.

As an example, a GUI can be generated that provides an overview (e.g., an overview screen), along with graphical features for analog monitoring (e.g., of system gauges, etc.) for a hybrid system where, for example, such a GUI can operate as a servo system interface for an electric control system.

As an example, a GUI can include various elements that contribute to operational features for field equipment. For example, consider a framework that can generate various web-enabled components such as, for example, dynamic vector graphics (e.g., SVG), an equipment live chart with one or more trending tools, a 3D rendered solid cut-away animation, and web control-based system gauges (e.g., available for an analog change over).

As an example, a framework may generate instructions for rendering of a GUI where, for example, dynamic rendering of graphics may occur responsive to input received via one or more interactions with the GUI. As explained, features of one or more types of visualization frameworks may be utilized. For example, consider utilization of features associated with GLB and/or gITF. As an example, a GUI may be dynamically advanced on-the-fly responsive to one or more interactions to render graphics of equipment. For example, consider an interaction that selects a type of equipment where a graphics file can be accessed for that type of equipment and appropriately processed to render a representation of that type of equipment as part of an assembly. In such an example, code (e.g., script) may be executable to appropriately size and align graphics with one or more other graphics to thereby generate a graphical representation of an assembly of equipment (e.g., a BOP, etc.).

As an example, a GUI can be generated that interrelates system operation performance metrics, performance monitoring, and system alerts, which can enhance operational excellence and increase reliability. As an example, a GUI can provide for rendering of interrelated concepts that together form the basis of a human machine interface (HMI) operating and monitoring system. As an example, a GUI may provide visibility to monitor conditions of various pieces of equipment, to understand trends in usage or behavior, and to understand the impact of changes that an operator and/or that a controller may make.

As an example, a framework can improve HMIs for various equipment systems. For example, a framework can go beyond capabilities of an HMI generation approach for oil & gas application that is designed for the purpose of accessing control systems by and operator, as developed using text and indication-based depictions for status and alarms with conventional static graphics. For example, rather than static graphics, text and indication-based design, which may annoy an operator and increase risk of diversion from a GUI (e.g., user distraction), a framework can provide for enhanced, dynamic interactivity that helps to assure operator engagement. Such an approach may be implemented using lesser screen space (e.g., fewer changes from GUI to GUI, etc.) to make interactions more intuitive and streamlined. As an example, a framework can provide for enhanced responsiveness and intelligence that links operator desires with equipment availabilities and capabilities. Such a framework can generate one or more UIs that decrease demand for graphical controls, number of interactions (e.g., clicks), and overall time, whether to build a system that an operator has in mind or to explore multiple different systems that may meet performance goals or provide for optimal performance.

As an example, a framework can generate a web-based HMI application for accessing a control system that involves a single point of access (SPA) design concept, which can make the application more reliable, lightweight, memory efficient, and fast in processing with remote accessing ability.

As explained, with respect to BOP systems, a framework can include features for one or more types of BOP equipment, which can include, for example, an electro-hydraulic hybrid BOP control system, a complete electric BOP control system, etc.

Figure 6:
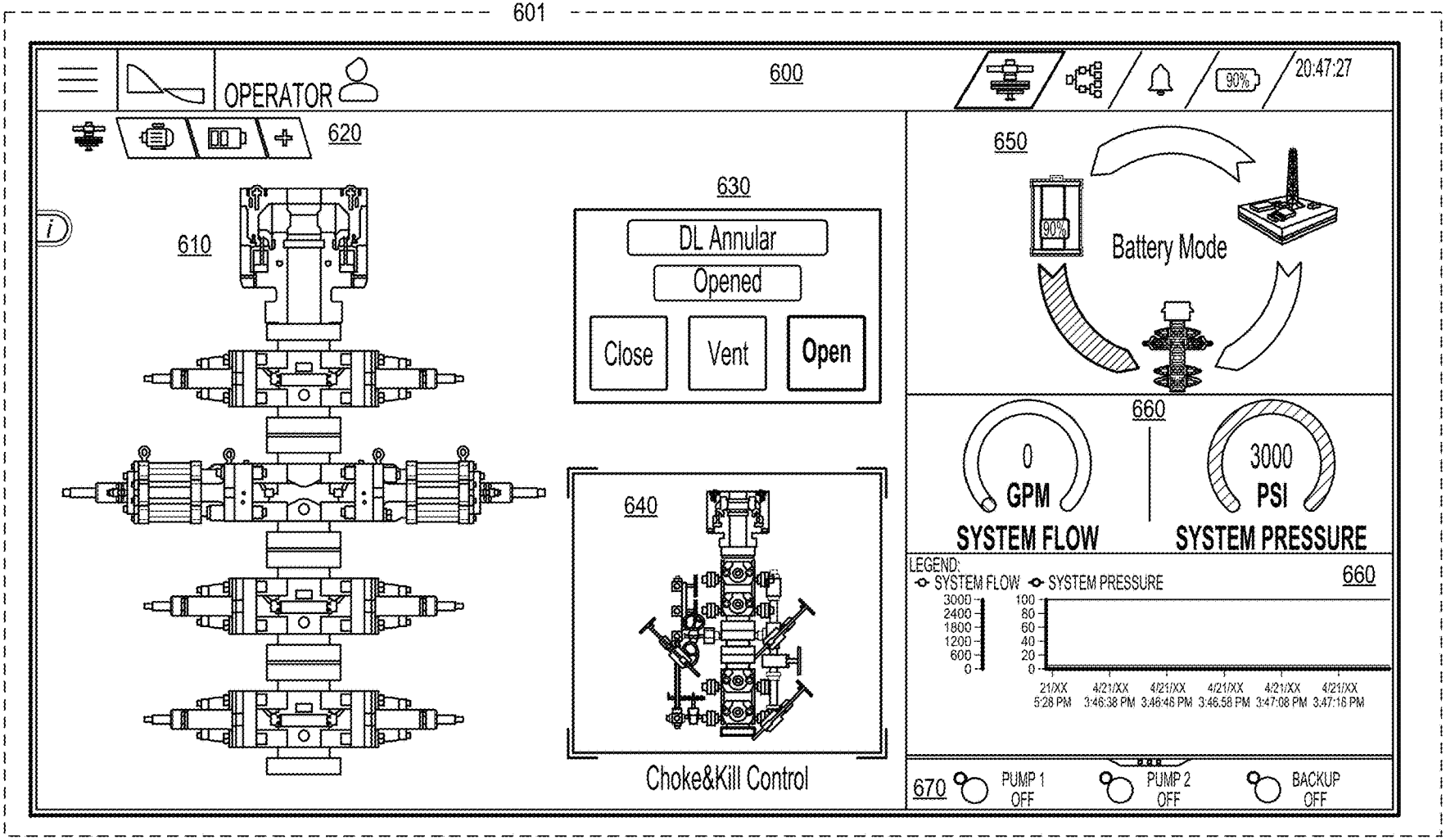
FIG. 6 illustrates an example of a graphical user interface.

FIG. 6 shows an example of a GUI 600 that includes various features where a dashed box represents a display screen or portion thereof 601 (e.g., where the GUI 600 is rendered to the display screen or portion thereof 601). For example, the GUI 600 can include a graphic 610 of equipment, which may be a vector graphic that is rendered to show a cut-away view of equipment. As explained with respect to the example assembly of components 380 of FIG. 3, various components may be assembled using flanges, which may utilize bolts. As an example, a ram assembly may be viewable at least in part via a cut-away view that slices through a bonnet. In such an example, an individual may be able to more readily identify one or more aspects of the ram assembly, along with one or more aspects of the bonnet and/or one or more aspects of a body, for example, where the ram assembly, bonnet and body are coupled together.

As an example, a GUI may include one or more features for adjusting a view, which may be a cut-away view (e.g., consider adjusting one or more cutting planes, etc.). As an example, the graphic 610 may be interactive where a perspective view may be changed, a cutting plane or cutting planes may be altered, etc. In such an example, one or more colors, shadings, dynamic graphics, etc., may be utilized to indicate function, condition, state, etc., of one or more aspects of the equipment. As an example, the graphic 610 may be generated via a configuration file that specifies equipment components where graphics can be accessed and assembled for conveying information as to actual field equipment (e.g., a field assembly of components). As explained, features of visualization frameworks may be utilized such as, for example, one or more features of OpenGL, WebGL, GLB, gITF, etc., may be utilized.

In the example of FIG. 6, the GUI 600 also includes a graphic 620 that can indicate statuses of a pump or pumps, a battery or batteries, a motor or motors, etc. In such an example, the graphic 620 may be extensible (see plus sign) to include statuses of one or more other aspects of a system (see, e.g., the system 500 of FIG. 5).

As shown, the GUI 600 can include a graphic 630 that provides for equipment control. For example, field equipment can include an annular preventer that can be opened, closed, vented, etc. The graphic 630 may include a status along with control graphics that can be actuated to control the state of field equipment (e.g., open, close, vent, etc.).

In the example of FIG. 6, the GUI 600 can include a graphic 640 that corresponds to various operations for field equipment, which may include, for example, choke and kill operations. As an example, the graphic 640 may be an actuatable graphic that can be interactive to perform control, change a state of field equipment, etc.

As shown, the GUI 600 can include a graphic 650 that indicates power information. For example, consider rendering of an operational mode indicator that can indicate a mode of power supplied to field equipment, which may be the field equipment rendered in the graphic 610. As shown, a battery mode may be implemented where a battery or batteries have a particular state of charge (SoC) that may be given as a percentage of a full SoC. As an example, the graphic 650 can indicate whether the battery or batteries are operatively coupled to and/or receiving power from another source such as, for example, a rig, a grid, a solar array, a wind turbine, a gas turbine, etc. In the example of FIG. 6, the graphic 650 indicates that the battery or batteries may receive power from a rig (e.g., diesel engines of a rig, etc.), however, the arrow shown is not highlighted, which may indicate that such power is not currently being delivered to the battery or batteries, for example, due to the SoC being above a threshold (e.g., at 90 percent, which is sufficient to power the field equipment). As an example, where a SoC drops below a threshold, power from one or more sources may be delivered to the battery or batteries where, for example, the graphic 650 can indicate the source or sources and power is being delivered (e.g., to increase the SoC). The graphic 650 may also indicate whether the field equipment is receiving power from the rig or source other than the battery or batteries. For example, an arrow that is not highlighted points from the rig to the field equipment where, as it is not highlighted, power is not being delivered by the rig to the field equipment; rather, per the highlighted arrow, power is being delivered from the battery or batteries to the field equipment.

As explained, a GUI can include one or more graphics that may mimic one or more analog gauges that may be in the field and that may include digital output. As shown, the GUI 600 can include graphics 650 that include gauges, for example, for system flow (e.g., in gpm) and for system pressure (e.g., in psi). As explained, the system 500 of FIG. 5 may operate according to a system pressure, which may be, for example, approximately 3,000 psi. In the example of FIG. 6, the graphics 650 include a system pressure graphic that reads 3,000 psi. At that system pressure, an operator may expect that there is no system flow, in other words, that the system flow graphic reads 0 gpm.

The GUI 600 may also include a graphic 660 that provides for rendering of data received from one or more field sensors. For example, the GUI 600 shows the graphic 660 that can provide system flow and system pressure with respect to time. The graphic 660 may provide for visualization of trends, operations, states, etc., of field equipment.

In the example of FIG. 6, the GUI 600 can include a graphic 670 that can be a status graphic for one or more pieces of equipment. For example, consider the graphic 670 as including statuses for multiple pumps, which may include a first pump, a second pump and a backup pump. As explained with respect to the system 500 of FIG. 5, multiple pumps may be included in a system, which may include one or more primary pumps and a backup pump that provides for redundancy (e.g., to help assure well control can be implemented as desired). As to status, the graphic 670 may indicate on, off, offline, unavailable, etc.

In combination, various graphics of the GUI 600 can provide an operator with a relatively complete explanation of what is happening in the field. For example, while the graphic 670 indicates that various pumps are off, this may be confirmed by the graphics 650 and 660, noting that if one of the pumps is to be turned on (e.g., transitioned to a different state), power is available via the one or more batteries to cause pump operation and generate system flow (e.g., flow greater than 0 gpm).

As an example, an operator may utilize the graphic 630 to initiate a control action as to one or more components of the field equipment shown in the graphic 610. For example, consider actuation of the close graphic (e.g., button) such that the annular preventer of the field equipment can be controlled, which can be via one or more of electric and hydraulic mechanisms. In turn, system pressure may change and/or one or more of the pumps may be actuated such that system flow occurs (see, e.g., the system 500 of FIG. 5). Per the graphic 660, an operator can see changes in system flow and/or system pressure with respect to time and, for example, per the graphic 670, an operator can see status of a pump or pumps.

The GUI 600 includes various functional features that can interface with a hybrid system, a hydraulic system, an electric system, etc. As explained with respect to the example of FIG. 6, the GUI 600 enables monitoring and/or control of a system, for example, without demanding that an operator navigate across multiple GUIs.

One or more GUIs may be generated by a computational framework for one or more types of systems such as, for example, a hybrid BOP control system and/or an electric BOP control system. A GUI may provide output for an operator via a modular platform that can be configured to control field equipment. As explained, a configuration file, which can be a digital file, may be generated that includes information as to field equipment and capabilities. Such a file can be generated by and/or consumed by a computational framework that generates a GUI for such field equipment.

As an example, a GUI can include a top banner that includes elements for operator log-in information, a user mapped datalogger interface, system enabled GUI navigation icons, an alarm counter system with interface navigation, and an application interface created on top banner that provides for smooth transitions across various GUIs, for example, using a single click. As an example, navigation graphics may be based on a web control interface that has a capability of extending or compressing, for example, to enable an operator to add additional navigation pages based on a design requirement, etc.

As an example, a GUI can include features for BOP equipment control and operation status, for example, for a system that can include one or more electric components (e.g., a hybrid system, an electric system, etc.). In such an example, a GUI can be generated using a system configuration design based on an entity order, which may be configured through an automated configurator (e.g., a computational framework that provides for generation of a configuration file, etc.). As an example, a GUI can be generated by a framework via a configuration file that enables a BOP object by utilizing display coordinate geometry. In such an example, a system configuration stack-up may be segregated based on one or more pre-defined back-end program sequences that can populate a 3D model (e.g., a vector graphics model, etc.).

As an example, a GUI can be generated by a framework using an object design library that can store pre-defined renderable models (e.g., graphics models, etc.), for example, based on BOP type, bonnet type and ram type, where an auto configuration process utilizes a display resolution and a stack configuration to load an entire BOP object element that reassembles as a solid 3D stack that may be rendered in an overview GUI. As an example, by utilizing a structured visibility approach, different stack elements can be populated based on configuration changes, which may help an operator to enable a live BOP stack based on a digital drill plan (e.g., generated by a planner, etc.).

As an example, a framework can provide for selection of components based on edge lighting embedded on borders of a system interface to enable a user to understand a selection, where, for example, an operation popup interface may be displayed that provides an operator a graphical control to trigger a sequence of actions. As an example, a sequence of actions may be a sequence of well control related actions as may be associated with a BOP, etc.

As an example, a GUI may provide for dual hand operation as may be interfaced into a system HMI along with popup confirmation that can be interfaced based on a command selected.

As an example, a GUI can render a 3D solid representation of a BOP, for example, with animated operating piston arrangements that may provide high-end visualization to help keep an operator engaged (e.g., not distracted). Such a GUI can be an improvement over a text-based and limited system design. For example, an animated system concept that interfaces a back-end tags based operational trigger to provide the status of equipment can provide an operator with more realistic representations of field equipment.

As an example, a GUI can become more intuitive when a created object design approach is implemented to represent actual operation, for example, through an enhanced manner of rendering images to represent the actual operation, which may be during a fault condition. As explained, a 3D model can be generated and utilized to represent the status of a system with an ability to provide a depiction of a process sequence in a realistic manner for actual field equipment.

As an example, a GUI can be generated for BOP equipment control and/or operation status for an electric system. Such a GUI may be generated using, for example, a configuration file and/or a configuration GUI. As explained, a framework can generate a 3D representation of field equipment, which may be a vector graphic representation. As an example, a GUI may be generated for closed loop feedback that can involve utilizing a resolver, an encoder, and drive feedback for an exact position of ram. Given such feedback, the GUI may render a dynamic or static representation of field equipment, for example, with positions of one or more rams. As an example, a GUI can provide for rendering of torque related information. For example, consider an approach with torque functionality integrated with ram movement and drive amperage associated with each drive motor where such information can be embedded with movement information. In such an example, a GUI can provide for rendering for monitoring and/or control of motor performance integrated with wellbore pressure. As an example, a GUI may provide for animated replay of one or more operations (e.g., a sequence of actions, etc.). For example, a framework may operate to store executed actions and to reconstruction such executed actions in the form of an animation, which may include graphical renderings of equipment.

As explained, a GUI can include a graphic for choke and kill control. For example, the GUI 600 includes an example graphic 640 associated with choke and kill control. As an example, choke and kill control monitoring can be provided by a GUI through an approach that can layer information onto a main control system. As an example, a GUI can provide for gesture interface navigation where, for example, responsive to a click, a choke and kill control interface GUI may be rendered, optionally as a pop-up.

As explained, a GUI can include a graphic for power flow. For example, consider a framework that can generate power flow sequence indications that can be represented based on the power flow to a stack on a hybrid system, an electric system, etc., where, for example, different modes of power flow may be represented on to the system (e.g., normal, battery power and rig power). As an example, for an electric system, where an electric BOP system is utilized, a GUI can render information to indicate power flow (e.g., holding, running and braking). As an example, a framework may provide for storage of various parameter values, which may be associated with a hybrid and/or an electric system. In such an approach, the framework may generate graphical animations that may be run forward or in reverse to assess one or more operational aspects of a field system. For example, such an approach may provide for assessment of operating procedures, which may include, for example, one or more standard operating procedures (SOPs).

As explained, a GUI can provide analog indicators. For example, consider one or more analog indicators for one or more sensors interfacing a well controller, which can include system sensors and well monitoring sensors that can be interfaced into a GUI for one or more of hybrid and electric BOP systems. As an example, web control-based gauges may be generated and configured, for example, with threshold levels (e.g., HiHi, Hi, Lo, LoLo, etc.) that may be mapped onto a master controller that drives a gauge display theme, which enables an operator to stay focused during operation.

As explained, a GUI can provide for trend visualization. For example, consider a system operation trend window that can be part of a GUI and rendered to a display, which may include real-time data. In such an example, a system trend window can be provided that interfaces with each operation. For example, consider a live plot that can include metrics such as system pressure, system flow and pump pressure, in case of hybrid BOP. As to an electric BOP, power flow corresponding to a close time may be captured, where a GUI can render one or more plots that may be stacked in an operation trend window.

As an example, a GUI can provide a pump overview window and/or a motor overview window. As an example, a pump overview window may be stacked on a system operation trend window, for example, as a gesture interface; noting that a motor overview window may be similarly displayed.

Figure 7:
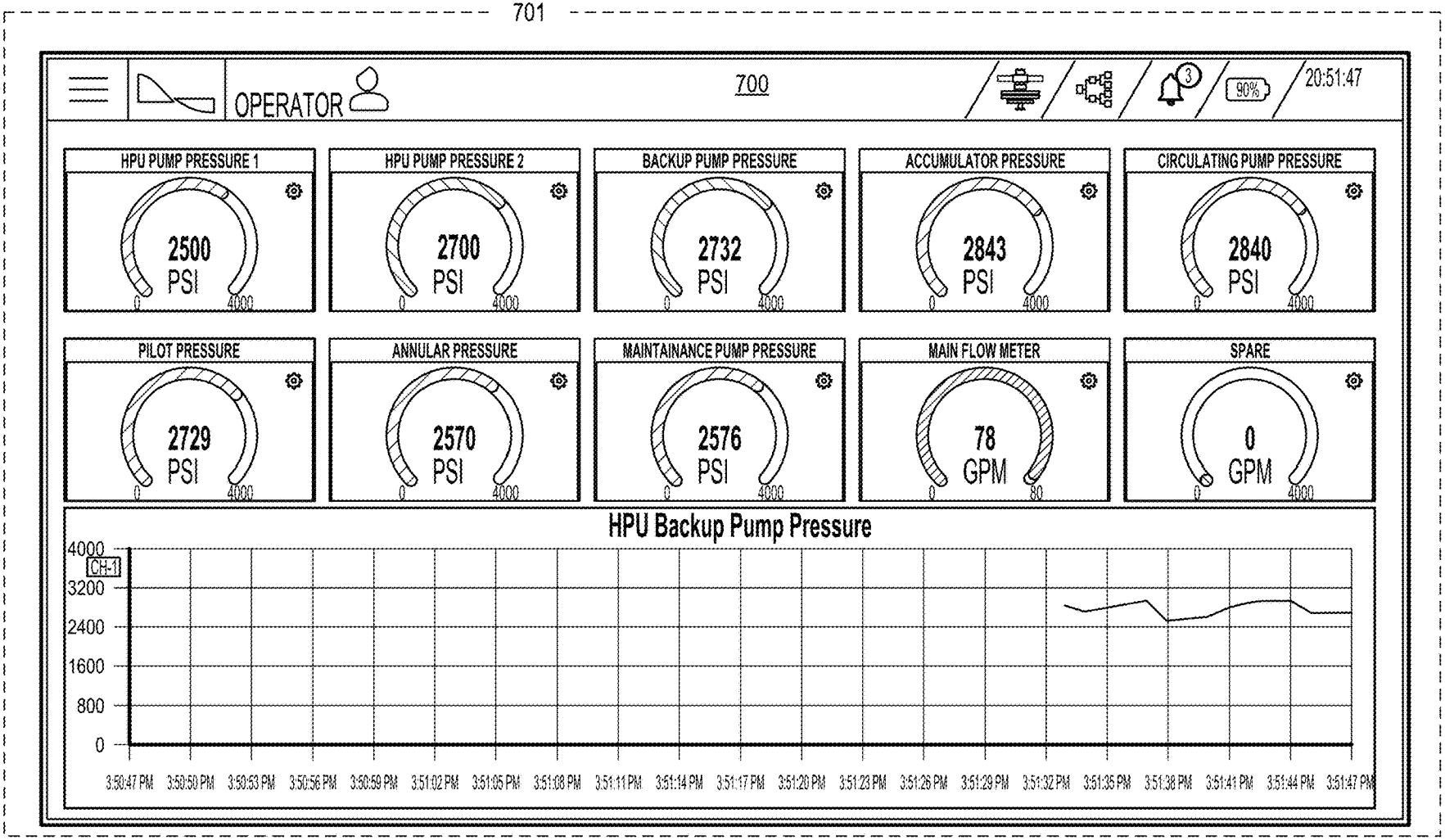
FIG. 7 illustrates an example of a graphical user interface.

FIG. 7 shows an example of a GUI 700 that can include one or more analog interface features where a dashed box represents a display screen or portion thereof 701. For example, the GUI 700 can include various graphics for gauge data that can be transmitted in real-time from field equipment to a framework for rendering. As shown, the data can be rendered in a plot with respect to time and/or as gauge faces for various measurements. As shown, the gauge faces can include gauge faces for HPU pump pressures, back-up pump pressure, accumulator pressure, circulating pump pressure, pilot pressure, annular pressure, maintenance pump pressure, main flow meter flow rate, and spare pump flow rate. In the example of FIG. 7, the GUI 700 includes a rendering of a plot of pressure versus time for HPU backup pump pressure, which can provide for indications of equipment operations, changes in states, trends, etc. While the GUI 700 includes various graphics for pumps and pressures, such a GUI may include various graphics for motors such as, for example, electric motors that may drive one or more pieces of equipment (e.g., an electric ram, etc.).

Figure 8:
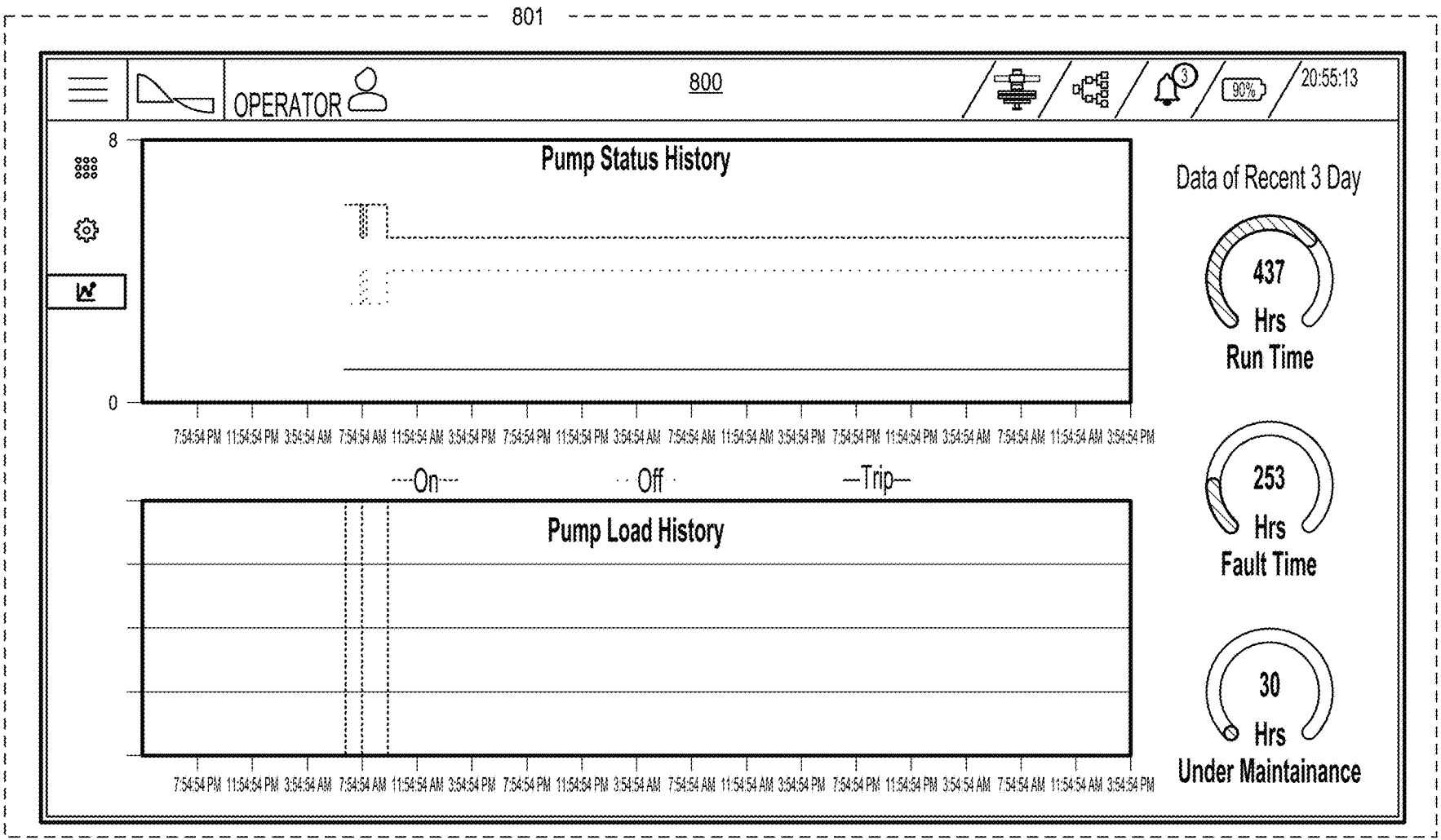
FIG. 8 illustrates an example of a graphical user interface.

FIG. 8 shows an example GUI 800 that includes graphics for plots of pump status history with respect to time and pump load history with respect to time, along with graphics for runtime, fault time, and time under maintenance for field equipment. In FIG. 8, a dashed box represents a display screen or portion thereof 801. While the GUI 800 includes various graphics for pumps, such a GUI may include various graphics for motors such as, for example, electric motors that may drive one or more pieces of equipment (e.g., an electric ram, etc.).

Figure 9:
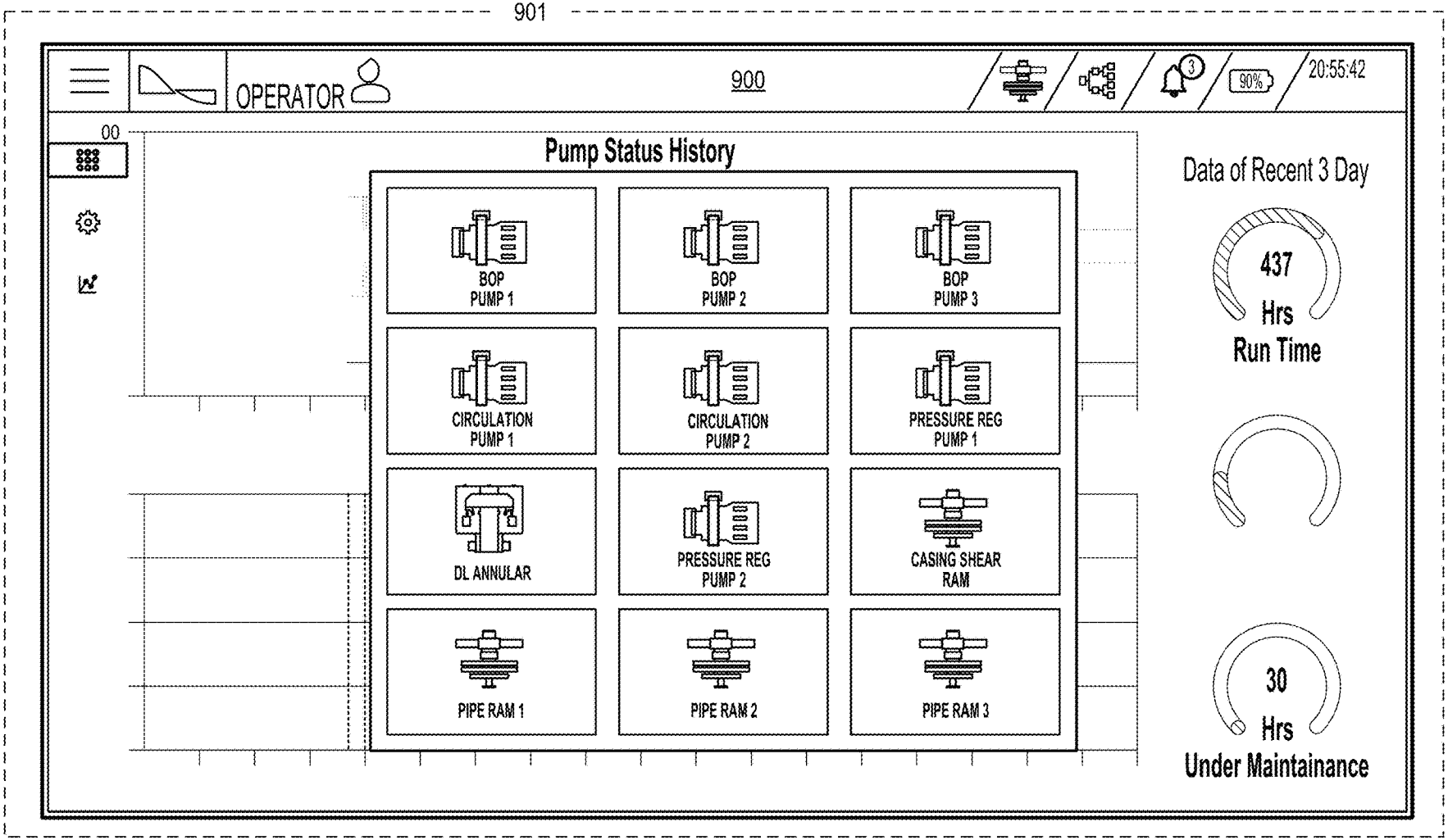
FIG. 9 illustrates an example of a graphical user interface.

FIG. 9 shows an example GUI 900 that includes various graphics that can be selectable for rendering information associated with one or more pieces of equipment. For example, a configuration file may provide information for one or more pieces of equipment as arranged in a system such as, for example, the system 500 of FIG. 5. In such an example, the GUI 900 can populate a menu of selectable equipment items of the system, which may be selected to render associated information such as, for example, sensor data, maintenance data, performance data, etc. As shown in FIG. 9, the GUI 900 can include menu items for pumps, preventers, etc., as may be included in a system, which may be hydraulically and/or electrically driven (e.g., controlled).

In FIG. 9, a dashed box represents a display screen or portion thereof 901. While the GUI 900 includes various graphics for pumps, such a GUI may include various graphics for motors such as, for example, electric motors that may drive one or more pieces of equipment (e.g., an electric ram, etc.).

As an example, a framework can generate GUIs for system sensors with different measurement channels connected into one or more of the GUIs. As explained, a GUI can provide individual graphics, plots, etc. As explained, plots can provide one or more features for trend analysis. As an example, a GUI can include one or more features for analysis of historic values, for example, as acquired by logging (e.g., recording data to one or more storage devices, etc.). As an example, a GUI can include one or more features for assessing current values with respect to historic values. As an example, a framework can provide web control-based gauges that may be configured according to a field equipment specification file (e.g., a configuration file), which may specify whether equipment is under hydraulic and/or electric control and/or actuation. As an example, a GUI can include gauges with threshold levels (e.g., HiHi, Hi, Lo, LoLo) that may be mapped in a master controller that drives a gauge display theme, which may help an operator to stay focused during operation. As an example, a GUI can utilize color, shading, dynamic features (e.g., flashing, blinking, etc.), etc., to ease operator understanding and awareness. As an example, a data logging function may be enabled for one or more analog signals from one or more analog gauges. As an example, a framework can include one or more analog to digital converters (ADCs) for generating digital signals from analog signals.

As explained, a system may be controlled using one or more power sources, which can include, for example, a UPS. As an example, a framework can generate one or more GUIs for a UPS interface in a hybrid BOP control system and/or an electric BOP control system. In such an example, GUI elements can include web components such as, for example, dynamic SVGs, an equipment live chart with a trending tool, 3D rendered solid cut-away animations and a web control-based battery interface that may, for example, enable operator monitoring of individual cells in a UPS.

As an example, a system can include a UPS that supplies power to one or more pumps and/or one or more electric rams, which may be called upon in one or more modes of operation (e.g., testing, emergency, well control, etc.). As an example, a UPS can supply power to a pump that can generate operational pressures for BOP equipment during an emergency mode. In such an example, the UPS parameters can be interfaced to a master controller and connected to a GUI. Such a GUI can be configurable, manually and/or automatically, for example, to allow for an operator to select one or more individual cells of the UPS and to monitor and/or control their states and/or performance.

As an example, a framework can generate GUIs that interrelate system operation performance metrics, performance monitoring and/or control, and system alerts as part of a scheme for improving operation excellence in a manner that can increase reliability. Various interrelated concepts can be brought together by a framework and rendered in the form of one or more GUIs, as an HMI, for operating, monitoring, controlling, etc., a field system. Such a GUI or GUIs can provide visibility to monitor the condition of various pieces of equipment, to understand trends in usage or behavior, and to understand impacts of changes that an operator and/or a machine may make to a system.

Figure 10:
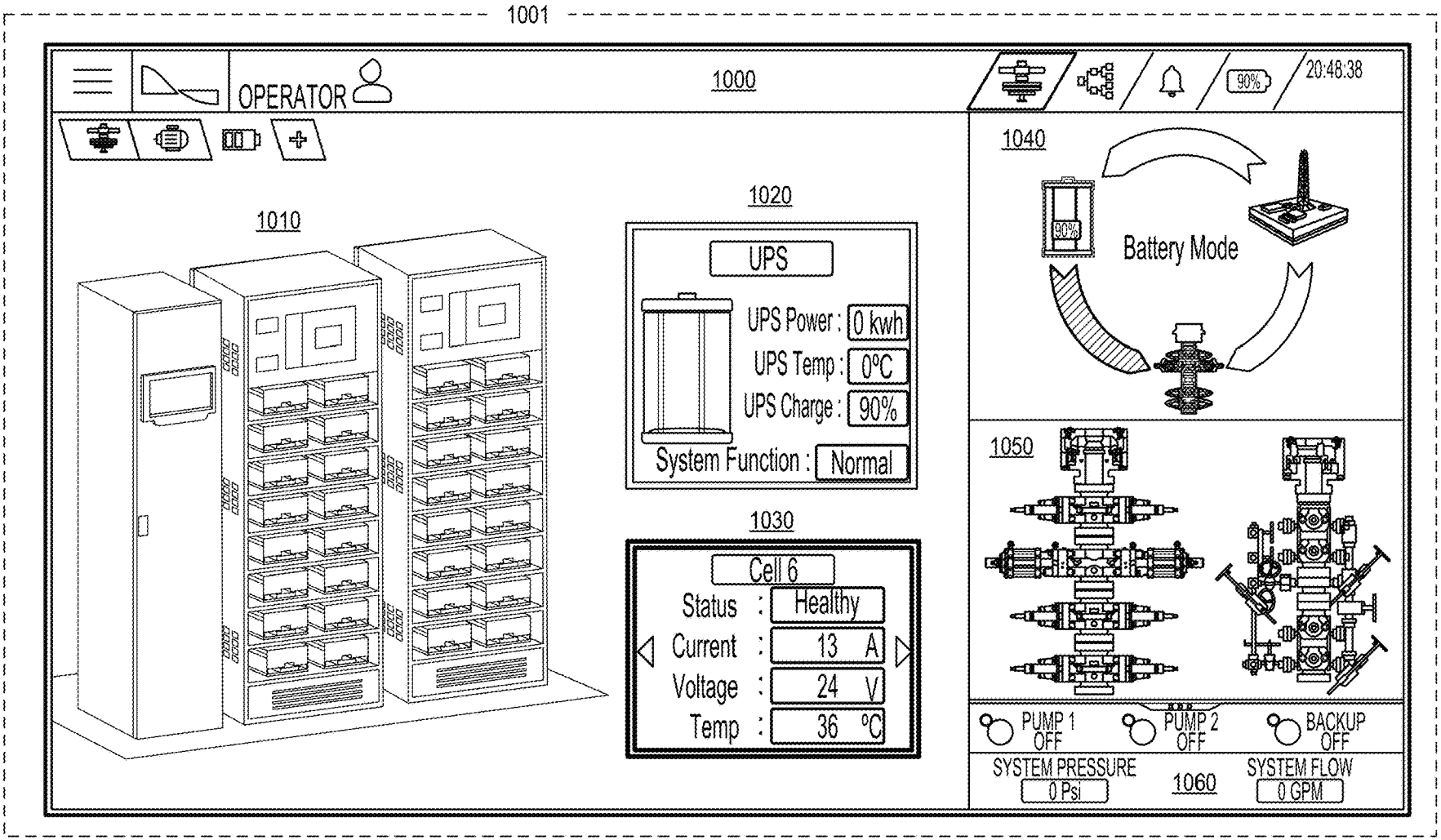
FIG. 10 illustrates an example of a graphical user interface.

FIG. 10 shows an example GUI 1000 that includes various graphics, which may include a graphic 1010 for a UPS, for example, as a vector graphics representation that can be adjusted, sliced, etc. For example, consider a UPS with various stacks of batteries where some may not be visible from an exterior perspective. In such an example, a cut-away view may provide for viewing an interior battery or batteries, which may be color-coded, etc., to represent SoC, performance, health, temperature, etc. In such an approach, an operator may view the GUI 1000 and adjust the graphic 1010 to inspect various individual batteries of the UPS. As an example, where a metric of a battery is compared to a threshold, the GUI 1000 may automatically adjust the graphic 1010 to show the battery or otherwise highlight the battery to expedite inspection by an operator. Such an approach can increase operator engagement, for example, from a remote location where risk to the operator may be minimized. In FIG. 10, a dashed box represents a display screen or portion thereof 1001.

Where a UPS includes lithium-ion batteries, risks may include risk of a thermal runaway. Such a process can occur within a battery if it becomes too hot, and it causes a chain reaction that can ultimately lead to a fire. In addition, thermal runaway can happen if a battery is exposed to abusive conditions such as high temperatures, physical abuse or if it is charged improperly.

During the thermal runaway of a battery, a chain reaction may vaporize organic electrolyte and pressurize a cell case. If or when the case around the battery begins to fail, flammable and toxic gases within the cell may be released, which can cause additional concerns. For example, after thermal runaway starts, it may become difficult to stop. For various reasons, a UPS with lithium-ion batteries may be located a distance away from one or more other fuels.

As an example, the GUI 1000 of FIG. 10 may include one or more graphics for gas detection and/or venting of a UPS if it utilizes lithium-ion batteries. As explained, temperature graphics may be rendered via a GUI, which may be on a battery-by-battery and/or other basis. Various batteries are designed to operate within a specific temperature range where, if they become too hot, they can become unstable, lead to thermal runaway, produce explosive gases or catch fire. As an example, a UPS can include one or more environmental control features (e.g., HVAC, fans, etc.), which may be monitored and/or controlled by a GUI.

As explained, battery charging and/or discharging may be monitored and/or controlled via a GUI. As an example, a lithium-ion battery failure may be caused by charging the battery improperly. Charging may be controlled by a battery management system, which may be accessible via a GUI. If a battery is overcharged or charged at a high current, it can cause metallic lithium to form within the battery. This can be problematic as metallic lithium is quite reactive and can cause a fire if it comes into contact with certain other materials within a battery, such as when the plated-out lithium can eventually form short circuits between internal battery components. As an example, a UPS can include various sensors that can provide data for rendering via a GUI, for example, as to physical stress, high temperatures, or improper charging and/or discharging.

In the example of FIG. 10, the GUI 1000 includes a graphic 1020 for a UPS, which can include fields for power, temperature, charge and/or system function. In such an example, a graphic representing the UPS may be rendered.

As shown, the GUI 1000 can include a graphic 1030 that may render information for specific cells in a UPS. For example, consider Cell 6, where information pertaining to health status, current, voltage and/or temperature may be rendered via the graphic 1030. As shown, the graphic 1030 may include navigation controls that provide for advancing from one cell to another of a UPS. As explained, the graphic 1010 can render information for particular cells where, for example, a cell may be highlighted in a manner that corresponds to a cell of the graphic 1030.

As shown in FIG. 10, the GUI 1000 can include a graphic 1040, which can include one or more features of the graphic 650 of the GUI 600 of FIG. 6. As to graphics 1050 and 1060, these can include one or more features of the graphics 610, 640 and 670 of the GUI 600 of FIG. 6.

As explained, a framework can generate one or more GUIs that can operate as a UPS system interface where the UPS can provide power to field equipment. As an example, a GUI for a hybrid BOP system can include a battery interface with advanced battery management system features that can be connected to a controller using one or more secured protocols. In such an example, connectivity may be elevated to one or more remote interface systems that can create a platform for advanced battery module management, which may aim to maximize availability of UPS power.

As explained, a UPS can include one or more battery racks enclosing individual cells where data from such cells and/or associated sensors can be interfaced to a GUI, for example, by utilizing web controls where each battery is connected to a data source for validating the system and, for example, in case of high and/or low threshold values, a GUI can render one or more alert graphics, which may be rendered in one or more forms (e.g., via the graphic 1010, the graphic 1030, etc.).

As an example, a GUI can include features for voltage logging, which can record voltage changes corresponding to individual cells. Such an approach enables operational team investigation of the derating factor of each individual cell, which may be utilized for planning of maintenance (e.g., replacement, etc.).

As an example, during an emergency operation, a UPS may experience some level of rapid discharge. As an example, a GUI can render a plot of discharge along with a pump load curve, where such values may be logged to provide a base for power management while an emergency mode is live.

As an example, a GUI can provide a system interface to one or more graphics, other GUIs, etc., for example, to render BOP information, pump information, etc., which may optionally be layered in a single GUI as an interface that help to make an operator stay aware (e.g., mentally engaged) and connected to various operational aspects of a system.

Figure 11:
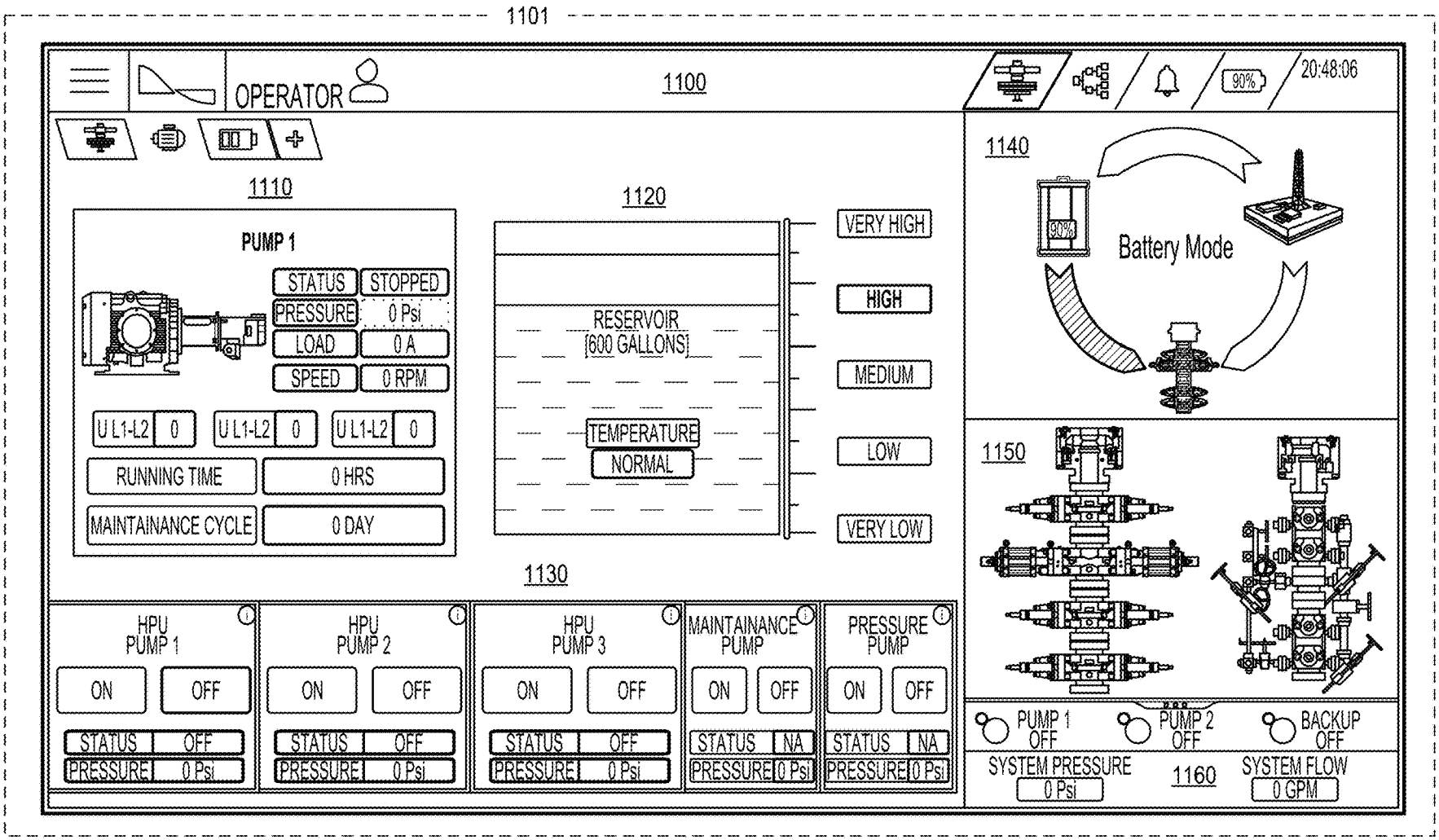
FIG. 11 illustrates an example of a graphical user interface.

FIG. 11 shows an example GUI 1100 for a hybrid pump system where the GUI 1100 can operate as an interface to the hybrid pump system. As shown, the GUI 1100 can include various graphics such as, for example, a pump graphic 1110 that can render a representation of a pump along with associated pump information. In such an example, the representation of the pump may be a vector graphics representation that may be based on information in a configuration file for a field system. As shown, the pump graphic 1110 can include fields for status, pressure, load, speed, running time, maintenance cycle, etc.

As shown in the example of FIG. 11, the GUI 1100 can include a graphic 1120 as to fluid, which may be fluid in a fluid reservoir that is operatively coupled to a fluid circuit where fluid may be driven by one or more pumps such as, for example, the pump of the pump graphic 1110. As shown, the graphic 1120 can indicate volume, level and temperature.

As shown, the GUI 1100 can include graphics 1130 for various pieces of equipment such as, for example, various pumps. As shown, the graphics 1130 include graphics for HPU pumps, a maintenance pump and a pressure pump, which may be components of a system such as, for example, the system 500 of FIG. 5. In each of the graphics 1130, one or more graphical controls may be rendered that can be actuated to cause a transition in a state of a corresponding piece of equipment. As shown, fields may be rendered as to status and pressure.

As shown in FIG. 11, the GUI 1100 can include a graphic 1140, which can include one or more features of the graphic 650 of the GUI 600 of FIG. 6. As to graphics 1150 and 1160, these can include one or more features of the graphics 610, 640 and 670 of the GUI 600 of FIG. 6. In FIG. 11, a dashed box represents a display screen or portion thereof 1101.

As explained, a framework can generate one or more GUIs for one or more pumps connected to a hybrid system, which may have various state signals and, for example, a soft starter system interfaced with the hybrid pump system that can provide signals to a control unit, which may be integrated into one or more GUIs.

As an example, the GUI 1100 may be a GUI that is rendered responsive to a selection made via the GUI 900 of FIG. 9, where, for example, a particular pump is selected. In such an approach, upon a hover over a pump graphic in the GUI 900, a menu may appear for navigation to one or more GUIs associated with the particular pump of the pump graphic. For example, consider a menu item for rendering data (e.g., plots, gauges, etc.) and/or a menu item for rendering visualizations such as in the example GUI 1100 (e.g., the graphic 1110). As explained, an individual pump of a system can be operated and monitored utilizing a GUI or GUIs.

As explained, the GUI 1100 can include the graphic 1120 that can render a reservoir (e.g., a tank) levels associated with fluid flow, which may be represented in a GUI along with one or more alarm indicators, which may be tied to or segmented based on a system flow level (e.g., as may be embedded in the reservoir). As shown, the graphic 1120 includes very high, high, medium, low and very low level indicators that can correspond with a level line within a graphic of the reservoir (e.g., tank) such that an operator can readily discern the status of the reservoir and fluid.

As an example, a GUI can provide for monitoring and/or control of a system such that system performance can be tied to flow and pressure. As an example, a GUI can provide for mapping a signal command or commands into the GUI to provide a foundation for monitoring real-time equipment feedback associated with one or more system sequences. As an example, such an approach can enable a functional sequence evaluation of one or more field operations (e.g., testing, emergency, well control, etc.).

As an example, a GUI can provide an interface for a BOP and a UPS where the UPS supplies electrical power to one or more system components for BOP control. As explained, a GUI can layer interface elements for a BOP and a UPS to make the GUI an interface suitable for an operator to stay connected across various operations of the BOP and the UPS.

As explained, a system that includes a BOP and a UPS may include electrically driven actuators such as electrically driven rams. Such a system may be referred to as an electrically driven BOP system, which is different than a hybrid (hydro-electric) driven BOP system.

As an example, a framework can generate one or more GUIs for an electrically driven BOP system where, for example, one or more electric drives connected to one or more ram assemblies where a drive system is operatively coupled to a master controller. In such an example, a system state of each drive system may be integrated into a GUI. As explained, a GUI can include elements for both a BOP and a UPS. In such an approach, an electrically driven BOP system may operate based on power supplied by the UPS where such power drives one or more rams (e.g., for testing, emergency, well control, etc.).

As an example, a GUI can include graphics for individual BOP equipment system components that can be operatively coupled to electricity provided by one or more power sources (see, e.g., the graphic 1140 of FIG. 11), where one of the one or more power sources can be a UPS (e.g., battery or batteries). In such an example, the GUI can provide for operating and monitoring the system and, for example, control of the system utilizing a GUI as a drive system interface.

As an example, electric drive performance associated with ram operation can be interfaced into a GUI or GUIs via a framework that generates the GUI or GUIs. As explained, a framework can utilize a system configuration file as a digital file to generate features for GUI rendering, system monitoring, system control, etc. As an example, a GUI can provide for a monitoring of a system and provide for real-time equipment feedback associated with one or more system sequences that may help to ensure operation is complete. For example, such a GUI can account for shear cases where the GUI can enable an operator to ensure proper shearing occurs (e.g., consider pipe shearing by an electrically driven ram). As an example, a GUI may render an animation of a ram that is being operated in real-time where the animation may track position of a ram with respect to a passage, a pipe, etc.

As explained, one or more GUIs can provide a system interface to a BOP and one or more power sources where elements may be layered in a GUI for use as an interface which allows an operator to stay connected across a number of functional operational tasks, which may be presented using one or more GUIs.

As an example, one or more GUIs may be operatively coupled to a control system for one or more types of field equipment. In such an example, the field equipment may include electrically driven equipment, which may be hydroelectric where electricity powers an electric motor of a pump and/or which may be electric where electricity powers an electric driver that drives a ram or rams. As to the latter, the electric driver may be an electric motor or other type of electric actuator. As an example, an electric motor may be a rotary motor and/or a linear motor.

As an example, a control system can include: a hybrid electric closing unit that includes: a tank including a usable volume for the control system; at least one primary pump configured to pump hydraulic fluid from the usable volume of the tank; a valve manifold including a plurality of valves; a pressure sensing system disposed between the at least one primary pump and the valve manifold; and a pressure storage reservoir, where the at least one primary pump, the pressure storage reservoir, the pressure sensing system, and the valve manifold are hydraulically connected with the tank, where the pressure sensing system manages a start-stop operation of the at least one primary pump, where hydraulic fluid within the control system has a predetermined static pressure; and where the at least one pump is powered by an electric energy source. In such an example, the electric energy source may be a UPS or another source (e.g., rig power, grid power, etc.). As explained, a framework can generate one or more GUIs that may provide for rendering of information associated with such a control system and, for example, interfacing with the control system to control one or more field operations, which may include actuating one or more pieces of equipment using electric energy (e.g., electrical power). While a hybrid system is mentioned, such a framework may suitably generate one or more GUIs for an electric system. For example, consider a system with one or more electrically operable rams where electric energy is utilized to directly move a ram of a BOP.

As explained, BOP systems (e.g., BOP stacks, etc.) can include various types of equipment, which may include features that are hydraulic, electric, hybrid, etc. Such systems can include well control interfaces for drive systems and control mechanisms. As an example, a computation framework can generate one or more user interfaces (UIs) for well orchestration where, for example, each component design used in a UI can include features associated with equipment monitoring, operating, troubleshooting, controlling, etc.

Figure 12:
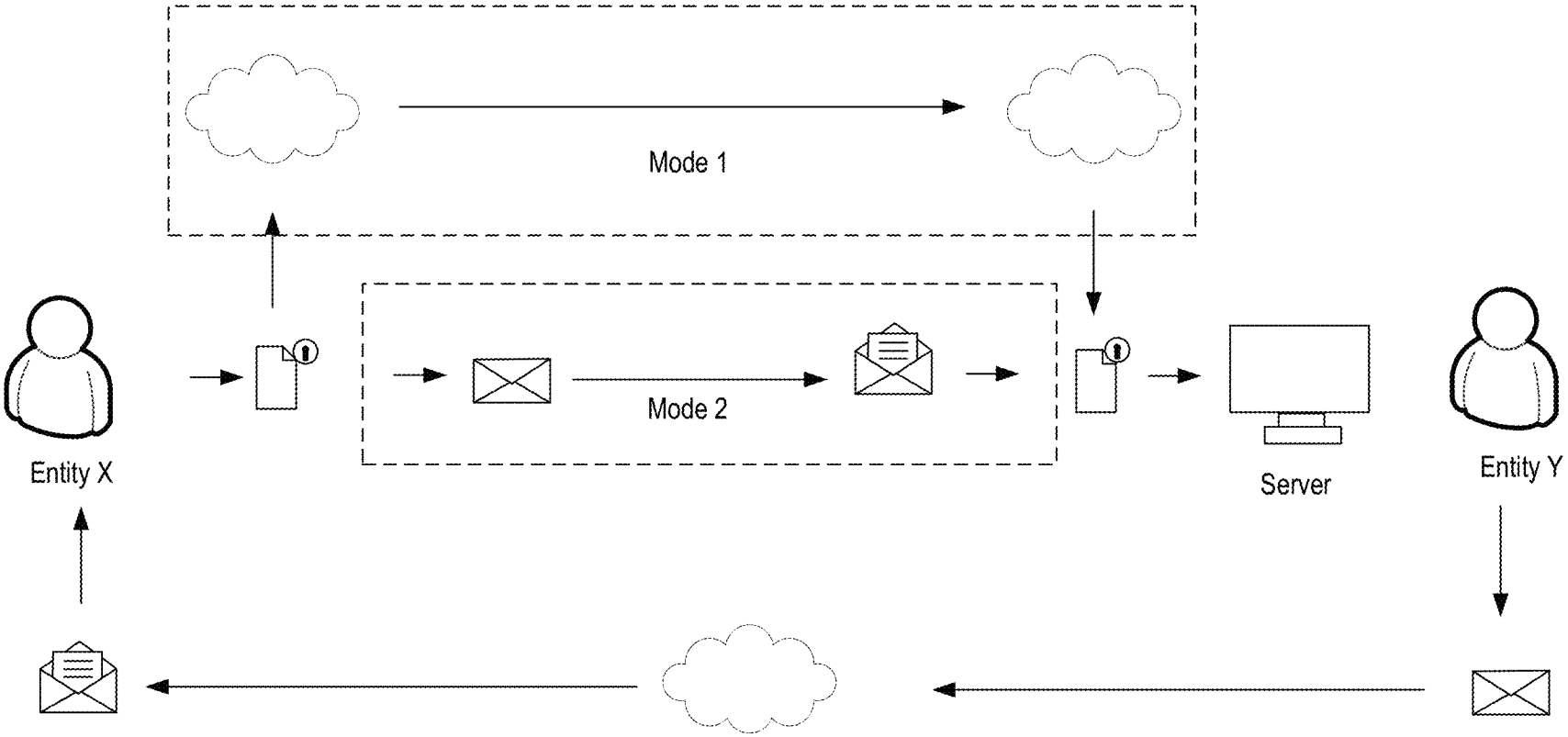
FIG. 12 illustrates an example of an architecture.

FIG. 12 shows an example of an architecture 1200 for operational modes of a framework (e.g., a computational framework) that can operate to generate a configuration file and/or one or more GUIs. As shown, the architecture 1200 can include two or more modes of operation. A first mode, mode 1, can be based on receipt of a digital message, which may be a digital file that specifies particular equipment; whereas, a second mode, mode 2, can be based on engineering of a system of equipment. As an example, a digital message may be an encrypted file developed based on a workflow for configuration of a BOP stack (e.g., corresponding to progression through a series of GUI interactions, etc.).

As to mode 1, a system configuration designed based on a digital transmission configured through an automated configurator enables a BOP object by utilizing display coordinate geometry. In such an example, a system configuration stack-up gets segregated based on a pre-defined back-end program sequence that can populate a 3D model. In such a mode of operation, an object design library can store pre-defined rendered models based on equipment types (e.g., BOP type, bonnet type, ram type, etc.) where an auto configuration tool utilizes display resolution and stack configuration to load an entire BOP object element that can be reassembled as a solid 3D stack in an overview screen. For example, by utilizing a structured visibility approach, different stack elements can be populated based on configuration changes, which dynamically allow an operator to visualize a BOP stack, for example, based on a drill plan.

As shown in FIG. 12, the operational modes can be utilized by various entities, which may be an entity X and an entity Y. In such an example, the entity X may be a supplier and the entity Y may be a client of the supplier. In various examples, an entity or entities can utilize a computational framework that may provide for generation of one or more GUIs and/or other information, which may be utilized for one or more purposes. As an example, a computational framework may provide for generation of one or more GUIs for building an assembly of equipment, for configuring a control system for an assembly of equipment, for controlling an assembly of equipment, etc. As an example, a computational framework may be accessible via one or more network connections, which may include one or more server connections (e.g., consider a back-end server and a front-end device that includes a display for rendering of one or more GUIs).

Figure 13:
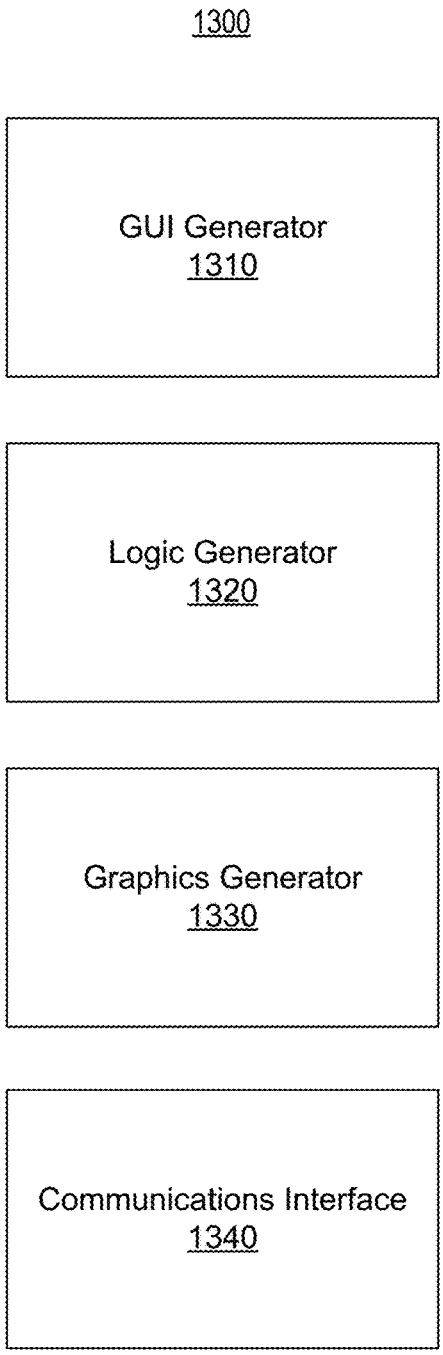
FIG. 13 illustrates an example of a framework.

FIG. 13 shows an example of a framework 1300 that includes a GUI generator 1310, a logic generator 1320, a graphics generator 1330 and a communications interface 1340. In the example of FIG. 13, the GUI generator 1310 can generate various GUIs with graphics, graphical controls, etc. As explained, a GUI or GUIs can be generated in accordance with logic, which can be dynamically implemented, for example, responsive to one or more interactions (e.g., user selections, etc.).

As an example, the logic generator 1320 can generate logic using data from one or more databases, which can include equipment catalog databases and/or standards databases. For example, consider generation of logic by accessing API standards where such standards may provide for sizing and/or equipment compatibilities with respect to systems of equipment. As an example, a logic generator may access one or more configuration files where, for example, certain configurations may be more common. In such an approach, listings of menu items may be ordered accordance to how commonly they are utilized. In such an approach, a more commonly used type of equipment may be at the top of a list, which can conserve time for a user (e.g., rather than having to look through an entire list, scroll, etc.). As an example, the logic generator 1320 can provide for input of digitized documents (e.g., scanned documents subjected to optical character recognition (OCR)). In such an approach, various fields may be identified along with data, descriptions, etc., pertaining to various pieces of equipment. As an example, one or more types of natural language processing (NLP) techniques may be applied to extract relevant information for logic generation (e.g., equipment compatibilities, etc.). As an example, logic may be generated for one or more types of actuators, controllers, power supply systems, etc. As mentioned, equipment may be hydraulic, hybrid, electric, etc.

As an example, the graphics generator 1330 can provide for generating various types of graphics, which can include graphical representations of pieces of equipment, whether alone or in one or more assemblies. As an example, an equipment supplier may provide access to one or more databases of computer-aided design (CAD) drawings, which may be in one or more types of formats (e.g., SVG, GLB, gITF, etc.). As explained, a framework may utilize vector graphics for generation of renderings of pieces of equipment and assemblies thereof (e.g., a BOP stack, etc.). As an example, a framework may include or be operatively coupled to a database of vector graphics files for various pieces of equipment. For example, consider the 2D representations of FIG. 3 and FIG. 4. As explained, a framework may provide for 3D graphics such that a piece of equipment or assembly of pieces of equipment can be rendered and viewed in a perspective view, a cutaway view, etc., which can help to provide some assurances to a user that the equipment comports with what the user expects. As an example, graphics may be generated for one or more types of actuators, controllers, power supply systems, etc. As mentioned, equipment may be hydraulic, hybrid, electric, etc. As an example, graphics may be generated and suitable for use in monitoring, control, etc. In such an approach, a framework can provide for an end-to-end workflow with output suitable for use in tasks from design to field implementation, monitoring and control. For example, a framework can generate a control dashboard using graphics generated as part of a design workflow. As an example, the graphics generator 1330 may include one or more features of one or more technologies (e.g., OpenGL framework, GLB, gITF, WebGL, etc.).

As to the communications interface 1340, as explained, it may be utilized for receipt of transmissions, which may provide data as to one or more modes of framework operation. As an example, such an interface may operate according to one or more communication protocols and using one or more types of technology.

As an example, a computational framework can include a graphical user interface (GUI) generator; a logic generator; and a graphics generator; where the GUI generator generates a GUI for configuring a system of well equipment based on selections of graphical menu items, where the GUI dynamically responds to an interactive selection of one of the graphical menu items based on logic generated by the logic generator, and where the graphics generator generates a vector graphics representation of the system of well equipment (e.g., as configured).

As an example, output of such a computational framework may be directed to one or more other frameworks. For example, consider output for use by a planner (e.g., DRILLPLAN, etc.), an operations framework (e.g., DRILLOPS, etc.), etc. As an example, a framework may be interactive with one or more other frameworks. For example, consider interactions between a planner and a configuration framework, an operations framework and a configuration framework, etc. As explained, one or more controllers may utilize output of a configuration framework and/or be interactive with a configuration framework (e.g., consider hydraulic control, hybrid control, electric control, etc.).

Figure 14:
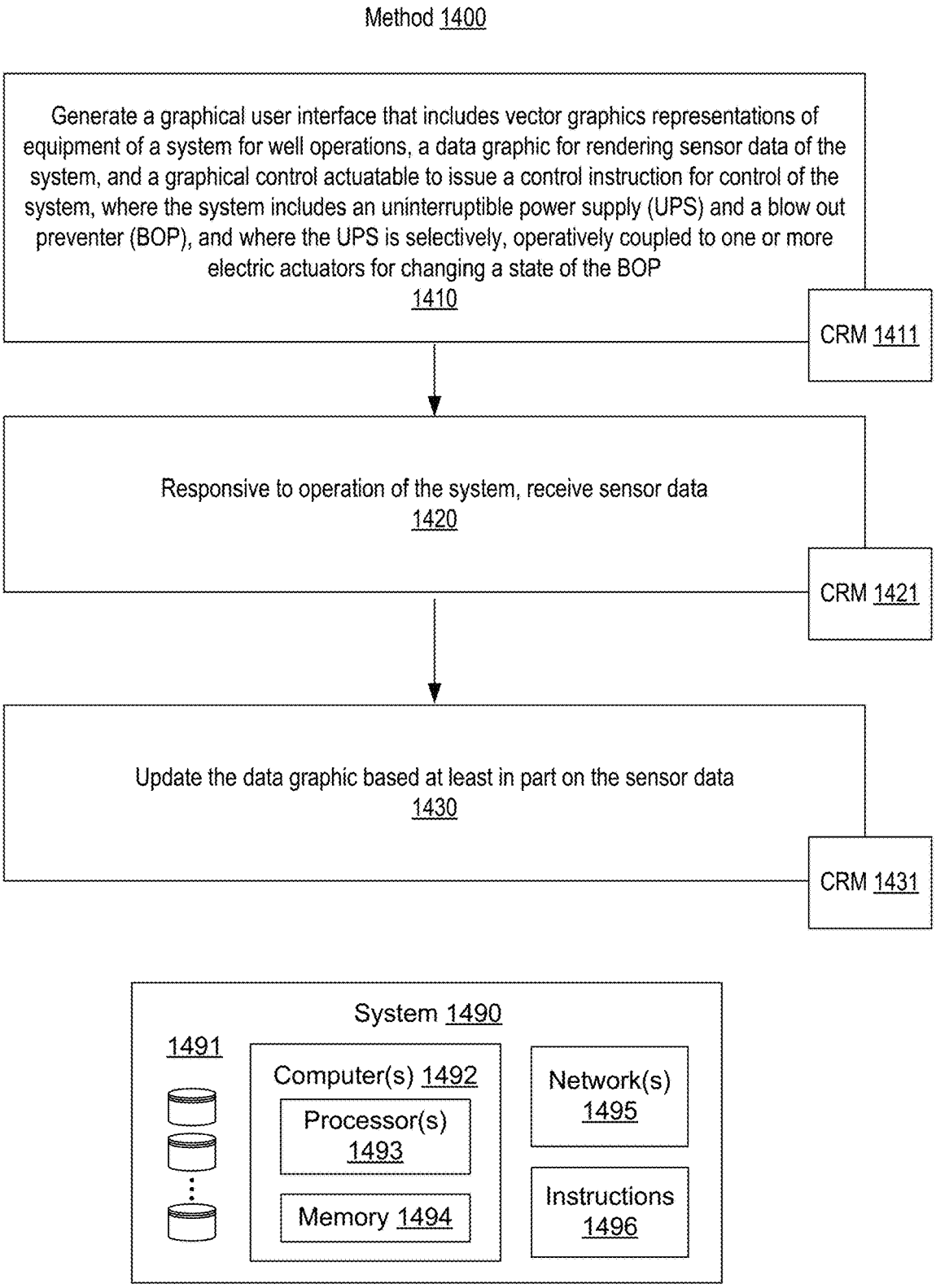
FIG. 14 illustrates an example of a method and an example of a system.

FIG. 14 shows an example of a method 1400 and an example of a system 1490. As shown, the method 1400 includes a generation block 1410 for generating a graphical user interface that includes vector graphics representations of equipment of a system for well operations, a data graphic for rendering sensor data of the system, and a graphical control actuatable to issue a control instruction for control of the system, where the system includes an uninterruptible power supply (UPS) and a blowout preventer (BOP), and where the UPS is selectively, operatively coupled to one or more electric actuators for changing a state of the BOP; a reception block 1420 for, responsive to operation of the system, receiving sensor data; and an update block 1430 for updating the data graphic based at least in part on the sensor data.

As an example, a method may utilize a computational framework to generate one or more GUIs. For example, consider use of a planner (e.g., DRILLPLAN, etc.), an operations framework (e.g., DRILLOPS, etc.), etc. As an example, a method may be interactive with one or more other methods, workflows, etc. For example, consider interactions between a planner and a method, an operations framework and a method, etc.

The method 1400 is shown in FIG. 14 in association with various computer-readable media (CRM) blocks 1411, 1421, and 1431. Such blocks generally include instructions suitable for execution by one or more processors (or processor cores) to instruct a computing device or system to perform one or more actions. While various blocks are shown, a single medium may be configured with instructions to allow for, at least in part, performance of various actions of the method 1400. As an example, a computer-readable medium (CRM) may be a computer-readable storage medium that is non-transitory and that is not a carrier wave. As an example, one or more of the blocks 1411, 1421, and 1431 may be in the form processor-executable instructions.

In the example of FIG. 14, the system 1490, which may be a wellsite system, can include one or more information storage devices 1491, one or more computers 1492, one or more networks 1495 and instructions 1496. As to the one or more computers 1492, each computer may include one or more processors (e.g., or processing cores) 1493 and memory 1494 for storing the instructions 1496, for example, executable by at least one of the one or more processors 1493 (see, e.g., the blocks 1411, 1421, and 1431). As an example, a computer may include one or more network interfaces (e.g., wired or wireless), one or more graphics cards, a display interface (e.g., wired or wireless), etc.

As an example, a system, a framework, a method, etc., may utilize one or more machine learning (ML) features, which can be implemented using one or more ML models. As to types of ML models, consider one or more of a support vector machine (SVM) model, a k-nearest neighbors (KNN) model, an ensemble classifier model, a neural network (NN) model, etc. As an example, a machine learning model can be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange various other frameworks.

As an example, a system may utilize one or more recurrent neural networks (RNNs). One type of RNN is referred to as long short-term memory (LSTM), which can be a unit or component (e.g., of one or more units) that can be in a layer or layers. A LSTM component can be a type of artificial neural network (ANN) designed to recognize patterns in sequences of data, such as time series data. When provided with time series data, LSTMs take time and sequence into account such that an LSTM can include a temporal dimension. For example, consider utilization of one or more RNNs for processing temporal data from one or more sources, optionally in combination with spatial data. Such an approach may recognize temporal patterns, which may be utilized for making predictions (e.g., as to a pattern or patterns for future times, etc.).

As an example, the TENSORFLOW framework (Google LLC, Mountain View, CA) may be implemented, which is an open source software library for dataflow programming that includes a symbolic math library, which can be implemented for machine learning applications that can include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method can include various actions that can operate on a dataset to train a ML model. As an example, a dataset can be split into training data and test data where test data can provide for evaluation. A method can include cross-validation of parameters and best parameters, which can be provided for model training.

The TENSORFLOW framework can run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system-based platforms.

TENSORFLOW computations can be expressed as stateful dataflow graphs; noting that the name TENSORFLOW derives from the operations that such neural networks perform on multidimensional data arrays. Such arrays can be referred to as "tensors".

As an example, a method can include generating a graphical user interface that includes vector graphics representations of equipment of a system for well operations, a data graphic for rendering sensor data of the system, and a graphical control actuatable to issue a control instruction for control of the system, where the system includes an uninterruptible power supply (UPS) and a blowout preventer (BOP), and where the UPS is selectively, operatively coupled to one or more electric actuators for changing a state of the BOP; responsive to operation of the system, receiving sensor data; and updating the data graphic based at least in part on the sensor data. In such an example, the method may, responsive to actuation of the graphical control, issuing the control instruction for control of the system. In such an example, consider, responsive to control of the system, receiving additional sensor data of the system indicative of a position of a component of the BOP, and updating one of the vector graphics representations for the component of the BOP to indicate the position of the component of the BOP.

As an example, at least one of one or more electric actuators may be or may include an electric motor. For example, consider an electric motor that may drive a fluid pump where, for example, the fluid pump is in fluid communication with a fluid circuit that includes a hydraulically operated ram of the BOP. As an example, at least one of one or more electric actuators may include an electric ram actuator of an electric ram of the BOP. In such an example, the electric ram actuator may be or include an electric motor.

As an example, a method can include rendering representations of equipment that include a representation of a UPS. In such an example, the UPS may include multiple batteries and the representation of the UPS may include a representation of at least one of the multiple batteries.

As an example, representations of equipment can include a representation of a BOP. For example, consider a representation of the BOP that includes a stack of preventers, where the preventers include one or more of a hydraulic ram preventer and an electric ram preventer.

As an example, representations of equipment can include a representation of a UPS and a representation of a BOP. In such an example, operations of the equipment may be indicated via one or more features of such representations, which may be interrelated. For example, consider power from the UPS driving mechanical motion of the BOP.

As an example, one or more data graphics may include a pressure data graphic, a fluid flow data graphic and/or a battery data graphic.

As an example, a method can include rendering a popup window that includes a menu of equipment items for at least two pieces of equipment of a system. In such an example, the method may include, responsive to a selection of one of the equipment items, generating another GUI that includes information for the selected one of the equipment items. For example, consider information that includes one or more of pressure data, flow data, and battery data.

As an example, a system can include a processor; memory accessible to the processor; processor-executable instructions stored in the memory and executable by the processor to instruct the system to: generate a graphical user interface that includes vector graphics representations of equipment of a system for well operations, a data graphic for rendering sensor data of the system, and a graphical control actuatable to issue a control instruction for control of the system, where the system includes an uninterruptible power supply (UPS) and a blowout preventer (BOP), and where the UPS is selectively, operatively coupled to one or more electric actuators for changing a state of the BOP; responsive to operation of the system, receive sensor data; and update the data graphic based at least in part on the sensor data.

As an example, one or more computer-readable storage media can include processor-executable instructions to instruct a computing system to: generate a graphical user interface that includes vector graphics representations of equipment of a system for well operations, a data graphic for rendering sensor data of the system, and a graphical control actuatable to issue a control instruction for control of the system, where the system includes an uninterruptible power supply (UPS) and a blowout preventer (BOP), and where the UPS is selectively, operatively coupled to one or more electric actuators for changing a state of the BOP; responsive to operation of the system, receive sensor data; and update the data graphic based at least in part on the sensor data.

As an example, a computer program product can include one or more computer-readable storage media that can include processor-executable instructions to instruct a computing system to perform one or more methods and/or one or more portions of a method. Various example methods may be performed in various combinations.

Figure 15:
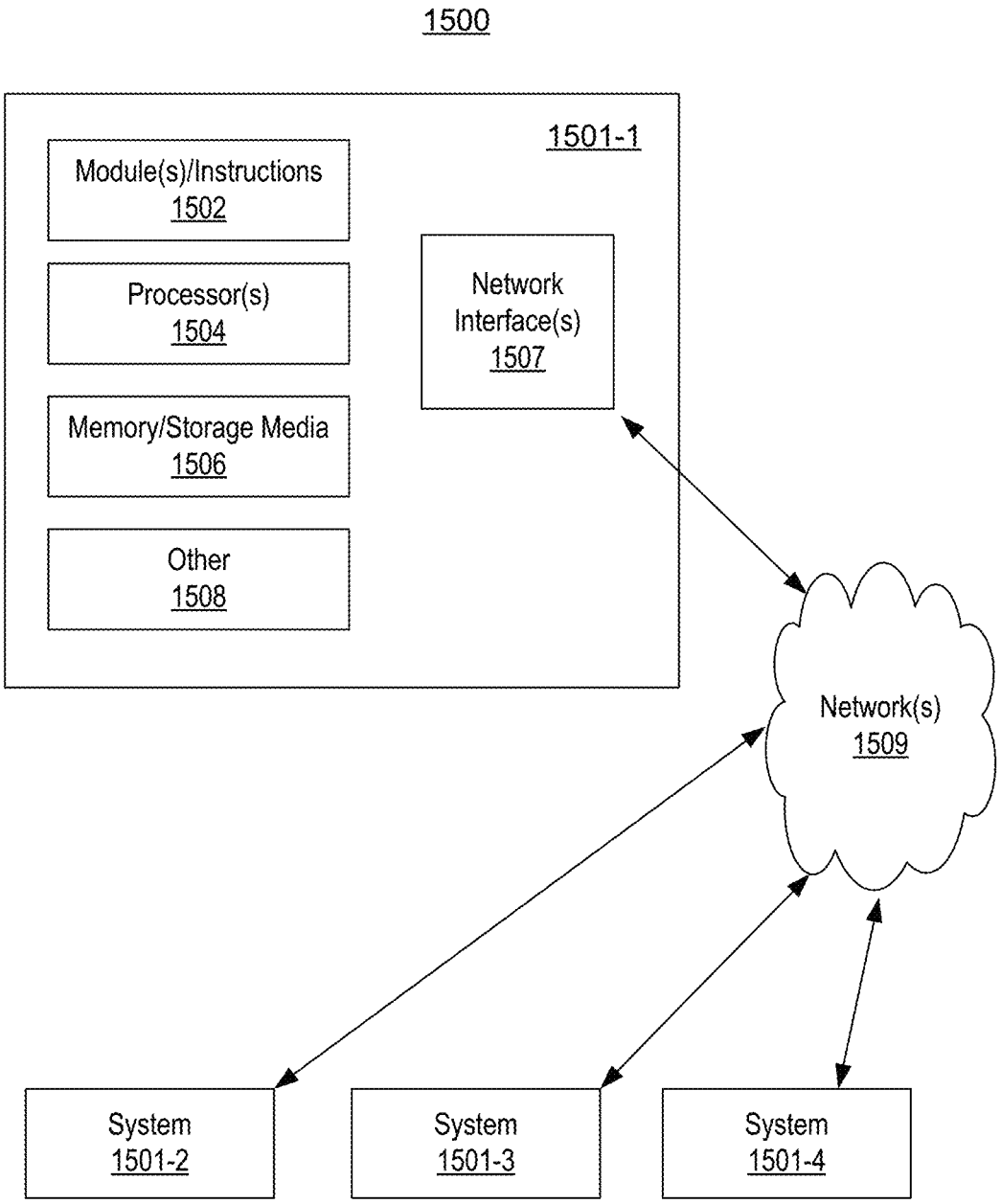
FIG. 15 illustrates examples of computer and network equipment.

In some embodiments, a method or methods may be executed by a computing system. FIG. 15 shows an example of a system 1500 that can include one or more computing systems 1501-1, 1501-2, 1501-3 and 1501-4, which may be operatively coupled via one or more networks 1509, which may include wired and/or wireless networks; noting that one or more other features 1508 can be included in the system 1500.

As an example, a system can include an individual computer system or an arrangement of distributed computer systems. In the example of FIG. 15, the computer system 1501-1 can include one or more modules 1502, which may be or include processor-executable instructions, for example, executable to perform various tasks (e.g., receiving information, requesting information, processing information, simulation, outputting information, etc.).

As an example, a module may be executed independently, or in coordination with, one or more processors 1504, which is (or are) operatively coupled to one or more storage media 1506 (e.g., via wire, wirelessly, etc.). As an example, one or more of the one or more processors 1504 can be operatively coupled to at least one of one or more network interface 1507. In such an example, the computer system 1501-1 can transmit and/or receive information, for example, via the one or more networks 1509 (e.g., consider one or more of the Internet, a private network, a cellular network, a satellite network, etc.).

As an example, the computer system 1501-1 may receive from and/or transmit information to one or more other devices, which may be or include, for example, one or more of the computer systems 1501-2, etc. A device may be located in a physical location that differs from that of the computer system 1501-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 1506 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general-purpose processors or application specific chips (e.g., or chipsets), such as ASICs, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

Figure 16:
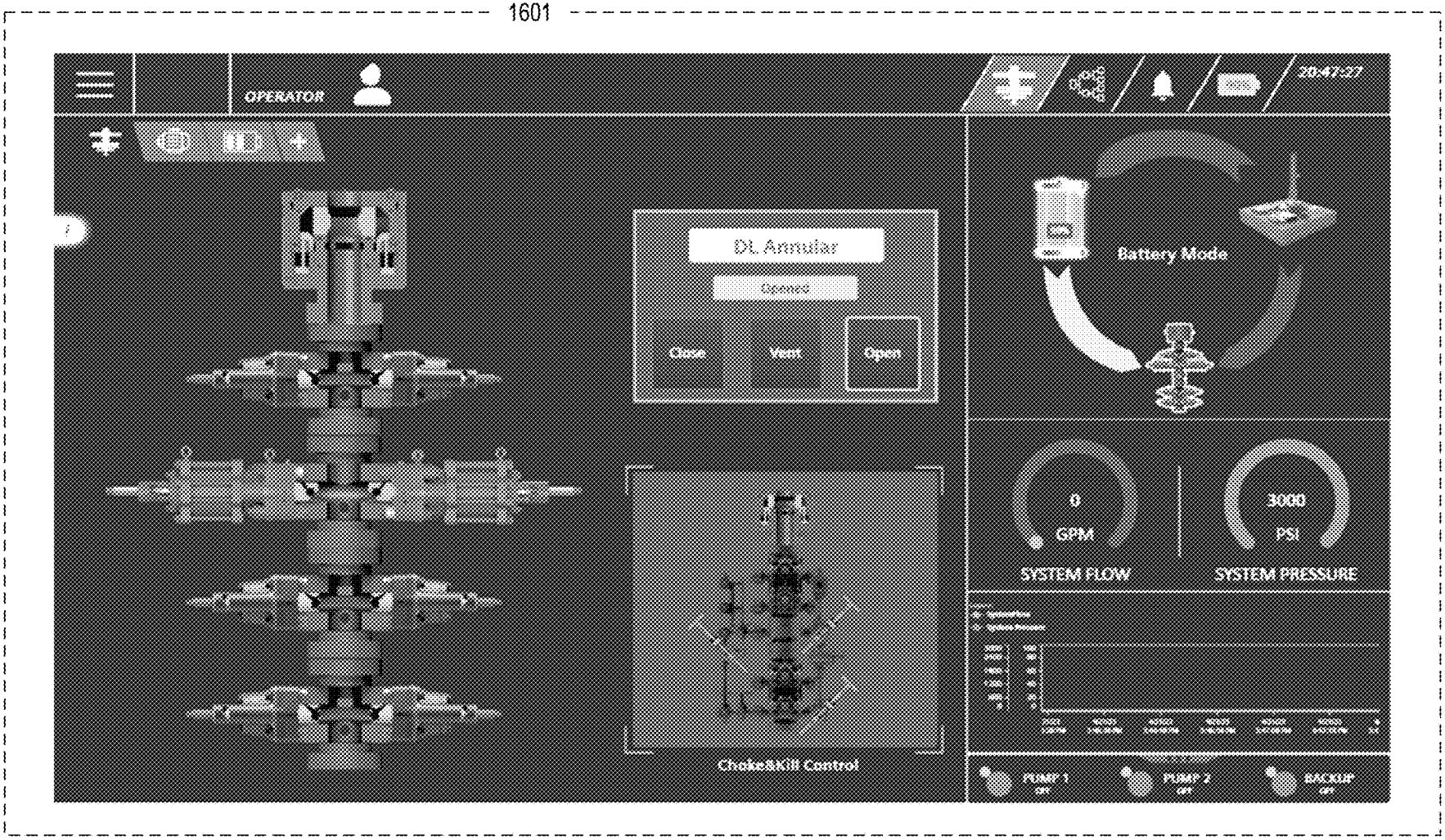
FIG. 16 illustrates a display screen or portion thereof with an example of a graphical user interface.

FIG. 16 illustrates a display screen or portion thereof with an example of a graphical user interface 1601.

Figure 17:
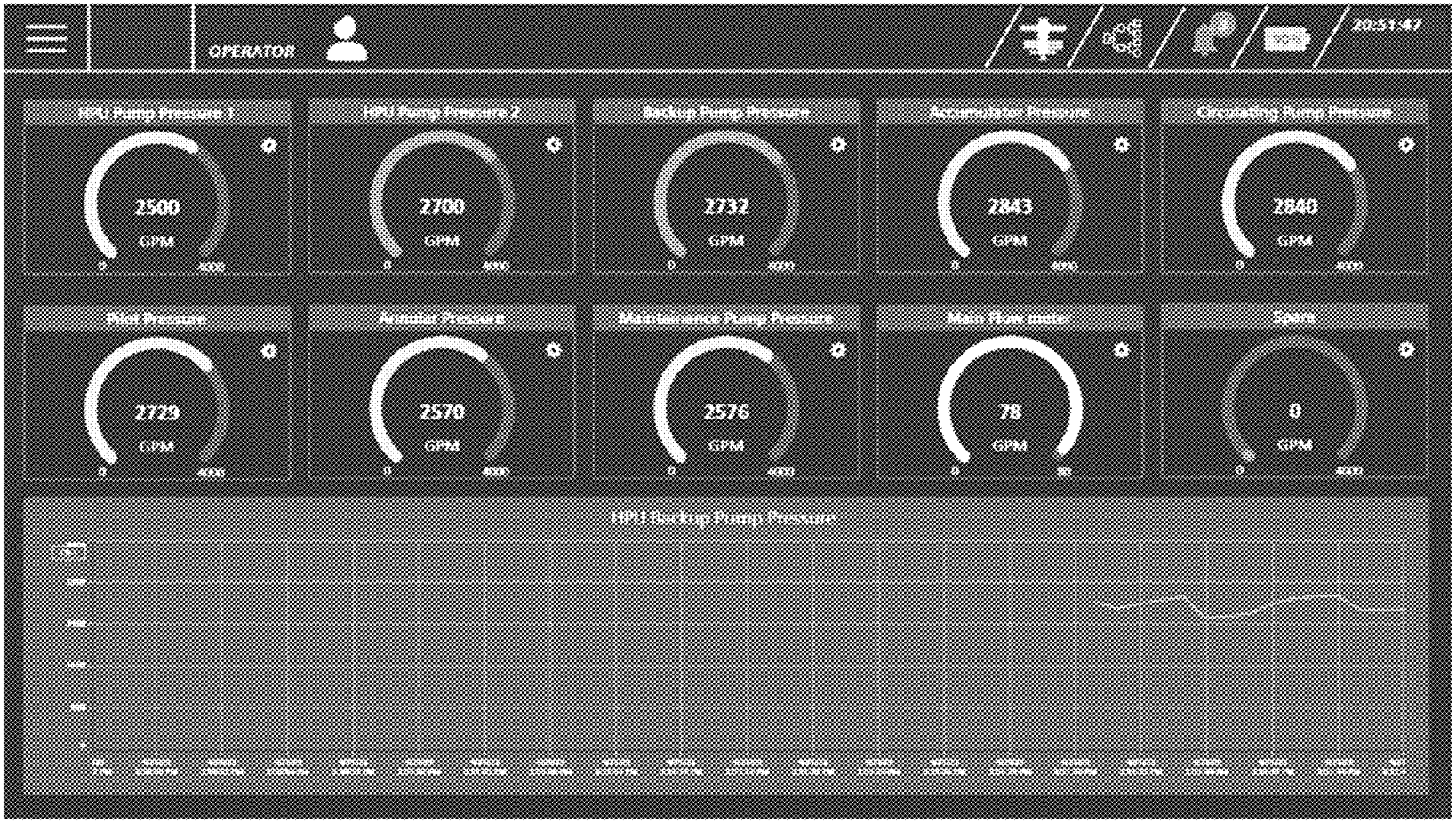
FIG. 17 illustrates a display screen or portion thereof with an example of a graphical user interface.

FIG. 17 illustrates a display screen or portion thereof with an example of a graphical user interface 1701.

Figure 18:
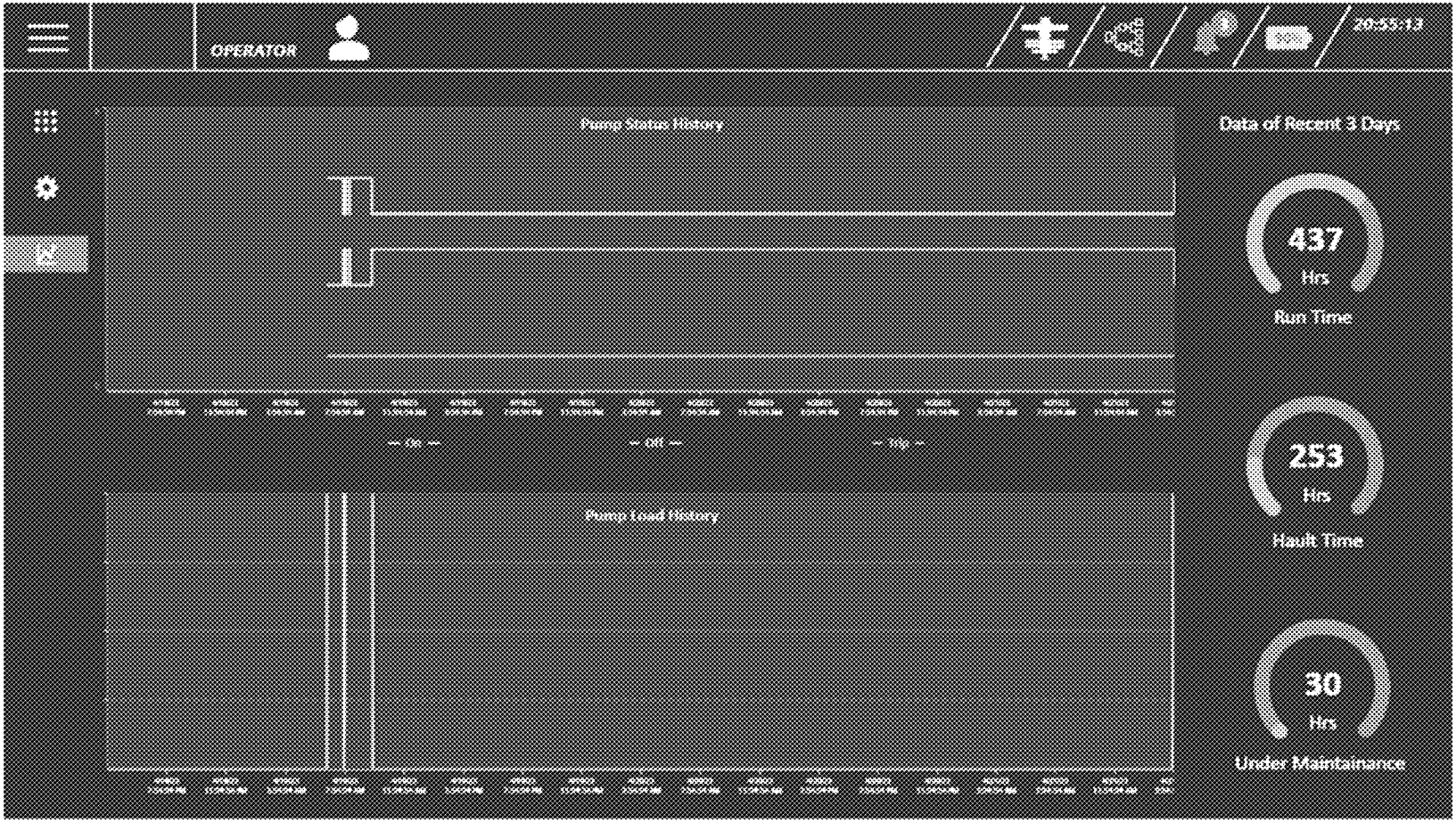
FIG. 18 illustrates a display screen or portion thereof with an example of a graphical user interface.

FIG. 18 illustrates a display screen or portion thereof with an example of a graphical user interface 1801.

Figure 19:
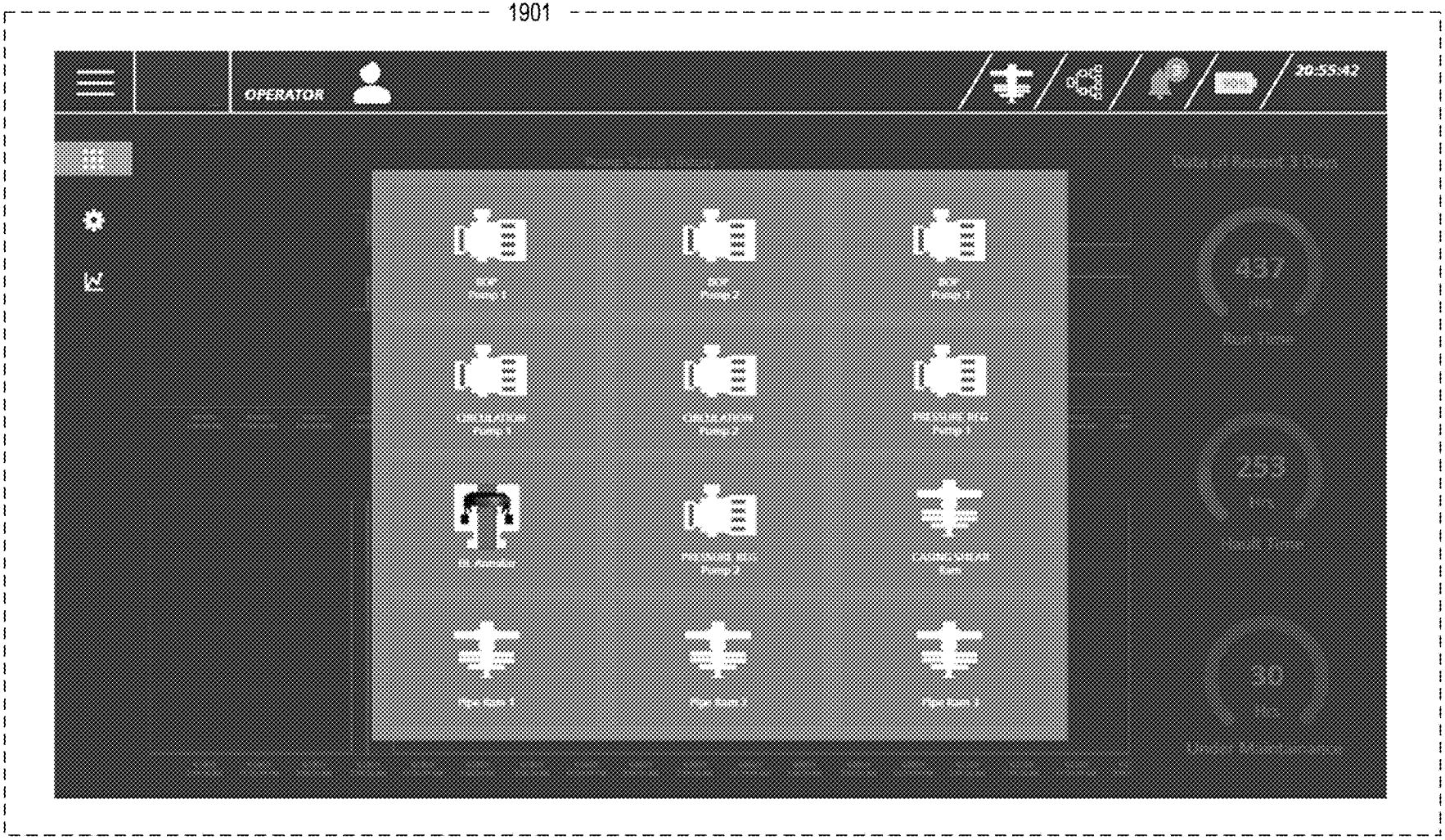
FIG. 19 illustrates a display screen or portion thereof with an example of a graphical user interface.

FIG. 19 illustrates a display screen or portion thereof with an example of a graphical user interface 1901.

Figure 20:
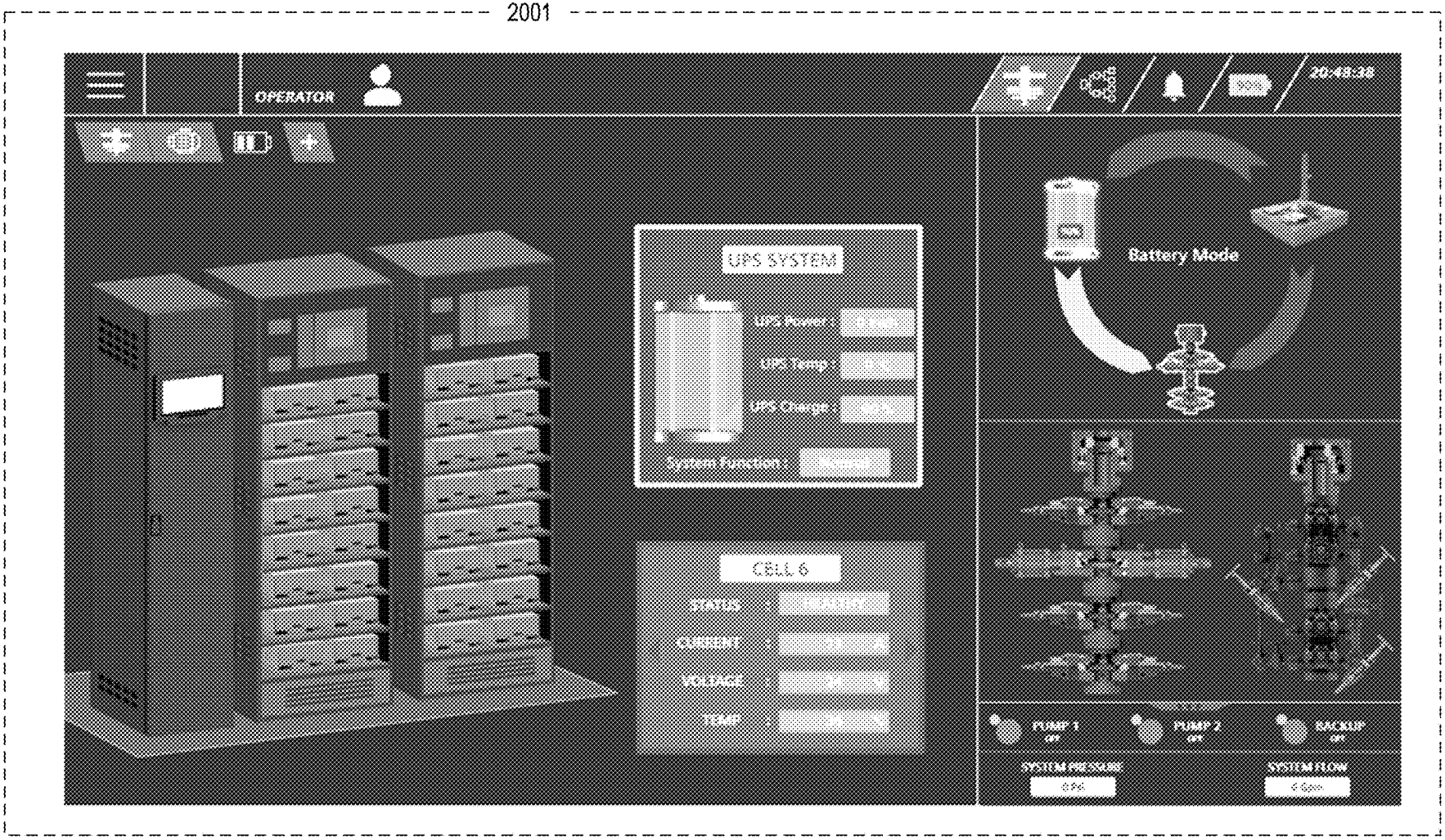
FIG. 20 illustrates a display screen or portion thereof with an example of a graphical user interface.

FIG. 20 illustrates a display screen or portion thereof with an example of a graphical user interface 2001.

Figure 21:
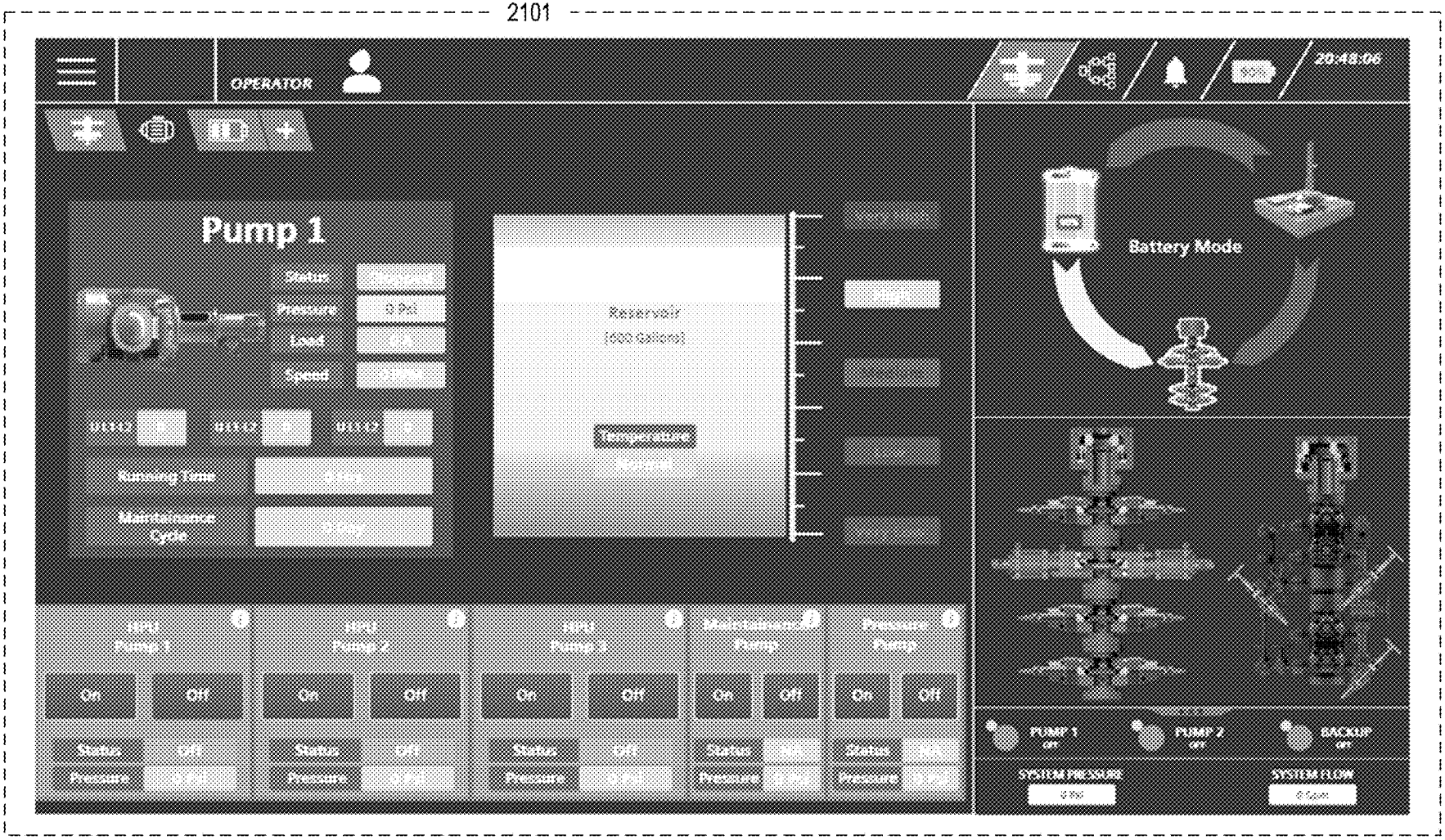
FIG. 21 illustrates a display screen or portion thereof with an example of a graphical user interface.

FIG. 21 illustrates a display screen or portion thereof with an example of a graphical user interface 2101.

In FIGS. 6 to 11 and FIGS. 16 to 21, the outermost broken lines show a display screen or portion thereof, and form no part of the designs of the graphical user interfaces. Various subject matter illustrated in various figures herein may include a process or period in which an image changes into another image.

Although only a few example embodiments have been described in detail above, those skilled in the art will readily appreciate that many modifications are possible in the example embodiments. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A system comprising:

a processor;

memory accessible to the processor;

processor-executable instructions stored in the memory and executable by the processor to instruct the system to:

generate a graphical user interface that comprises one or more vector graphics renderings of equipment of a system for well operations, one or more data graphic renderings of real-time sensor data values of the system, and one or more graphical controls actuatable to issue a control instruction for control of the system, wherein the system comprises an uninterruptible power supply (UPS) and a blowout preventer (BOP), wherein the UPS is selectively, operatively coupled to one or more electric actuators for changing a state of the BOP, and wherein the one or more vector graphics renderings of the equipment comprise a vector graphics rendering of the UPS;

responsive to operation of the system, receive sensor data; and update the one or more data graphic renderings of the real-tie sensor data values based at least in part on the sensor data.

2. One or more non-transitory computer-readable storage media comprising processor-executable instructions to instruct a computing system to:

generate a graphical user interface that comprises one or more vector graphics renderings of equipment of a system for well operations, one or more data graphic renderings of real-time sensor data values of the system, and one or more graphical controls actuatable to issue a control instruction for control of the system, wherein the system comprises an uninterruptible power supply (UPS) and a blowout preventer (BOP), wherein the UPS is selectively, operatively coupled to one or more electric actuators for changing a state of the BOP, and wherein the one or more vector graphics renderings of the equipment comprise a vector graphics rendering of the UPS;

responsive to operation of the system, receive sensor data; and update the one or more data graphic renderings of the real-time sensor data values based at least in part on the sensor data.

3. A method comprising:

generating a graphical user interface that comprises one or more vector graphics renderings of equipment of a system for well operations, one or more data graphic renderings of real-time sensor data values of the system, and one or more graphical controls actuatable to issue a control instruction for control of the system, wherein the system comprises an uninterruptible power supply (UPS) and a blowout preventer (BOP), wherein the UPS is selectively, operatively coupled to one or more electric actuators for changing a state of the BOP, and wherein the one or more vector graphics renderings of the equipment comprise a vector graphics rendering of the UPS;

responsive to operation of the system, receiving sensor data; and updating the one or more data graphic renderings of the real-time sensors data values based at least in part on the sensor data.

4. The method of claim 3, wherein at least one of the one or more electric actuators comprises an electric motor.

5. The method of claim 4, wherein the electric motor drives a fluid pump.

6. The method of claim 5, wherein the fluid pump is in fluid communication with a fluid circuit that comprises a hydraulically operated ram of the BOP.

7. The method of claim 3, wherein at least one of the one or more electric actuators comprises an electric ram actuator of an electric ram of the BOP.

8. The method of claim 1, wherein the UPS comprises multiple batteries, and wherein the vectors graphics rendering of the UPS comprises a vector graphics rendering of at least one of the multiple batteries.

9. The method of claim 3, further comprising, responsive to actuation of one of the one or more graphical controls, issuing the control instruction for control of the system.

10. The method of claim 9, further comprising responsive to control of the system, receiving additional sensor data of the system indicative of a position of a component of the BOP, and updating one of the one or more vector graphics renderings of the component of the BOP to indicate the position of the component of the BOP.

11. The method of claim 3, wherein the one or more vector graphics renderings of the equipment further comprise a vector graphics rendering of the BOP.

12. The method of claim 11, wherein the vector graphics rendering of the BOP comprises a vector graphics rendering of a stack of preventers, wherein the stack of preventers comprises at least one of a hydraulic ram preventer or an electric ram preventer.

13. The method of claim 3, wherein the one or more data graphic renderings of the real-time sensor data comprises a data graphic rendering of real-time pressure data.

14. The method of claim 3, wherein the one or more data graphic renderings of the real-time sensor data comprises a data graphic rendering of real-time fluid flow data.

15. The method of claim 3, wherein the one or more data graphic renderings of the real-time sensor data comprises a data graphic rendering of real-time battery data.

16. The method of claim 3, further comprising rendering a popup window on the graphical user interface, wherein the popup window comprises a menu of equipment items for at least two pieces of the equipment of the system.

17. The method of claim 16, further comprising, responsive to a selection of one of the equipment items, generating another graphical user interface that comprises information for the selected one of the equipment items.

18. The method of claim 17, wherein the information comprises at least one of pressure data, flow data, or battery data.

* * * * *